US010358333B2

(12) United States Patent
Luo

(10) Patent No.: US 10,358,333 B2
(45) Date of Patent: Jul. 23, 2019

(54) INTEGRATED ALCOHOLIC BEVERAGE FRESH-KEEPING BARREL SYSTEM

(71) Applicant: Ningbo Major Draft Beer Equipment Co., Ltd., Ningbo, Zhejiang Province (CN)

(72) Inventor: Bangcai Luo, Ningbo (CN)

(73) Assignee: Ningbo Major Draft Beer Equipment Co., Ltd. (CN)

( * ) Notice: Subject to any disclaimer, the term of this patent is extended or adjusted under 35 U.S.C. 154(b) by 0 days.

(21) Appl. No.: 15/752,504

(22) PCT Filed: Nov. 12, 2015

(86) PCT No.: PCT/CN2015/094385
§ 371 (c)(1),
(2) Date: Feb. 13, 2018

(87) PCT Pub. No.: WO2017/067030
PCT Pub. Date: Apr. 27, 2017

(65) Prior Publication Data

US 2018/0237282 A1 Aug. 23, 2018

(30) Foreign Application Priority Data

Oct. 21, 2015 (CN) ..... 2015 1 0689969
Oct. 21, 2015 (CN) ..... 2015 2 0818168 U

(51) Int. Cl.
*B67D 1/04* (2006.01)

(52) U.S. Cl.
CPC ..... *B67D 1/04* (2013.01)

(58) Field of Classification Search
CPC ..... B67D 1/04
(Continued)

(56) References Cited

U.S. PATENT DOCUMENTS 4,921,135 A * 5/1990 Pleet ..... B67B 7/26 222/105
6,105,825 A * 8/2000 Gomi ..... B67D 1/0832 222/146.6

(Continued)

FOREIGN PATENT DOCUMENTS

CN 101670997 A 3/2010
CN 102153040 A 8/2011

(Continued)

OTHER PUBLICATIONS

International Search Report for corresponding PCT Application No. PCT/CN2015/094385 dated Jul. 28, 2016.

*Primary Examiner* — Vishal Pancholi
(74) *Attorney, Agent, or Firm* — Wood, Phillips, Katz, Clark & Mortimer

(57) ABSTRACT

An integrated alcoholic beverage fresh-keeping barrel system, comprising a housing, and an inner container, wherein the inner container is divided into two layers, and comprises a gas storage tank located at the upper layer for storing gas and an alcoholic beverage barrel located at the lower layer for storing a liquid beverage; the gas storage tank and the alcoholic beverage barrel are coaxially arranged one above the other; a gas channel that can be opened and closed is provided between the gas storage tank and the alcoholic beverage barrel; the alcoholic beverage barrel is provided with a liquid outlet end and an outflow liquid channel for opening and closing the liquid outlet end; a control system is provided above the gas storage tank; the control system controls the opening and closing of the gas channel, and performs linkage control on the opening and closing of the outflow liquid channel.

16 Claims, 18 Drawing Sheets

(58) Field of Classification Search
USPC ..... 222/55, 95, 195, 386.5, 399, 400.7
See application file for complete search history.

(56) References Cited

U.S. PATENT DOCUMENTS

| | | | | |
|---|---|---|---|---|
| 7,753,239 | B2 * | 7/2010 | Chang | B67D 1/0462 222/105 |
| 2003/0062383 | A1 | 4/2003 | Meike et al. | |
| 2004/0134939 | A1 * | 7/2004 | van der Klaauw | B67D 1/0829 222/400.7 |
| 2008/0142553 | A1 * | 6/2008 | Lassen | B67D 1/0412 222/399 |
| 2013/0313290 | A1 * | 11/2013 | Lassen | B67D 1/0412 222/399 |
| 2015/0239600 | A1 * | 8/2015 | Patel | B65D 21/0228 215/6 |

FOREIGN PATENT DOCUMENTS

| | | | |
|---|---|---|---|
| CN | 20226398 | U | 6/2012 |
| CN | 205035068 | U | 2/2016 |
| DE | 202005012157 | U1 | 9/2006 |
| WO | 2006029626 | A1 | 3/2006 |

* cited by examiner

INTEGRATED ALCOHOLIC BEVERAGE FRESH-KEEPING BARREL SYSTEM

FIELD OF THE INVENTION

The present invention relates to a beer fresh-keeping barrel, and more particularly to an integrated alcoholic beverage fresh-keeping barrel system.

BACKGROUND OF THE INVENTION

Draught beer is a world-renowned wonderful work in beer due to its "pure flavor, fresh and delicious". However, since it must be sold and stored in complex and specialized equipment, its popularity is limited and it cannot find its way into every family. Although cask beer use fresh beer (draught beer without being sterilized), but there is no enough pressure in the barrel to maintain the content of carbon dioxide in the wine. In the process of barreling, transportation and sale, the wine may be in contact with air to oxidize, thus undermining the taste and flavor of wine.

With the development of draught beer containers, 5 L draught keg introduced by Heineken makes up for the above defects and can keep the quality of fresh beer to the last drop. However, because the wine barrels cannot be reused, the price is high and it is unfavorable for environmental protection. Besides, the carbon dioxide compression system (fixed with glue) included in the barrel is mixed with the liquor, which makes consumers suspicious of the hygiene. Therefore, it is urgent to design a product to solve the above shortcomings of beer packaging and to provide low-cost high-quality fresh beer for consumers.

SUMMARY OF THE INVENTION

The main technical problem to be solved by the present invention is to provide an integrated alcoholic beverage fresh-keeping barrel system. The system is provided, from top to bottom, with a gas storage tank, an alcoholic beverage barrel and an ice cube placing region in a housing in sequence to form an integrated structure, and is compact in structure, easy to carry, and capable of keeping the flavor and the taste of draft beer to the last drop. Therefore, it can be widely used in various parties, sports competitions, restaurants, banquets, outdoor tourism, and other places.

The technical solution adopted by the present invention to solve the above technical problem is as follows. An integrated alcoholic beverage fresh-keeping barrel system comprises a housing and an inner container wrapped by the housing. The inner container is divided into two layers, comprising a gas storage tank located at an upper layer for storing a gas and an alcoholic beverage barrel located at a lower layer for storing a liquid beverage. The gas storage tank and the alcoholic beverage barrel are coaxially arranged one above the other.

A gas channel that can be opened and closed is provided between the gas storage tank and the alcoholic beverage barrel. The alcoholic beverage barrel is provided with a liquid outlet end and an outflow liquid channel for opening and closing the liquid outlet end. A control system is provided above the gas storage tank. The control system controls the opening and closing of the gas channel and performs linkage control on the opening and closing of the outflow liquid channel.

In the above technical solution, the gas storage tank and the alcoholic beverage barrel are connected by soldering to form the integral inner container. The structure is more compact more convenient to carry and transport. The inner container is covered by the housing. On the one hand, the housing can protect the inner container; on the other hand, the space above the inner container can be covered by the housing to accommodate the related components of the control system that controls the gas storage tank and the alcoholic beverage barrel. The space below the inner container is covered by the housing can be placed with ice cubes for cooling the alcoholic beverage barrel so as to ensure the taste and flavor of the wine.

In the aforesaid technical solution, "the control system controls the opening and closing of the gas channel and performs linkage control on the opening and closing of the outflow liquid channel" means when the control system opens the gas channel, the outflow liquid channel is also opened. When the operator uses the integrated alcoholic beverage fresh-keeping barrel system of the present invention, the gas storage tank needs to be filled with carbon dioxide, and the alcoholic beverage barrel is filled with a liquid beverage. When the operator manipulates the control system to open the gas channel, the gas in the gas storage tank enters the alcoholic beverage barrel through the gas channel. When the pressure in the alcoholic beverage barrel reaches a certain value, the alcoholic beverage in the alcoholic beverage barrel is pressurized to flow out.

In the aforesaid technical solution, the inner container is covered by the housing, which provides a protection effect to ensure the safety of the fresh-keeping barrel during sale and transportation. The housing may be made of engineering plastics, and the inner container may be made of stainless steel.

The control system is provided with an actuating element for performing an action. The actuating element has a self-locking structure. When the actuating element is in a self-locking state, the gas channel is disconnected and the outflow liquid channel is closed. When a first action is performed on the control system, the gas channel is connected and the outflow liquid channel is open and the gas storage tank pressurizes the alcoholic beverage barrel; when the alcoholic beverage barrel reaches a certain pressure, the liquid in the alcoholic beverage barrel flows out from the liquid outlet end. When a second action is performed on the control system, the gas channel is disconnected and the outflow liquid channel is closed. When a third action is performed on the control system, the control system is in a self-locking state, the gas channel is disconnected and the outflow liquid channel is closed.

A base is formed below the housing. The alcoholic beverage fresh-keeping barrel system further comprises a cover. An upper end of the housing is provided with a feature connecting portion for mating and connecting with the cover. A lower end of the base is also provided with another feature connecting portion for mating and connecting with the cover. When the cover is mated and connected with the housing, a sealed space is formed between the cover and the container and located above the gas storage tank. When the cover is mated and connected with the base, another sealed space is formed between the cover and the container and located beneath the alcoholic beverage barrel.

In the aforesaid technical solution, the cover may be provided with ribs for the user to grip the cover conveniently.

In the aforesaid technical solution, the feature connecting portion may adopt a threaded structure. In one embodiment, the upper end of the housing and the cover may be connected together through the threaded structure. At this time, a sealed space is formed between the cover and the inner container and located above the gas storage tank. The sealed space is configured to accommodate the related components of the control system, which plays a role in protecting the control system to prevent the control system from being collided during the transportation of the fresh-keeping barrel. In an embodiment, the cover and the base are connected together through the threaded structure, a sealed space is formed between the cover and the inner container and located under the alcoholic beverage. The sealed space can be used for placement of ice cubes to cool the alcoholic beverage barrel so that the alcoholic beverage in the alcoholic beverage barrel can maintain the best taste and flavor.

The gas storage tank and the alcoholic beverage barrel are connected together by soldering. The gas storage tank and the alcoholic beverage barrel are connected together by soldering to be one-piece and constitute the inner container.

A top of the alcoholic beverage barrel is provided with an alcoholic beverage barrel opening. A gas storage tank opening is provided above the gas storage tank. A position relationship between the gas storage tank and the alcoholic beverage barrel is that a portion of an outer surface of an upper portion of the alcoholic beverage barrel forms a bottom surface of the gas storage tank. In an embodiment, the alcoholic beverage barrel has a dual-cone cylindrical shape.

The control system comprises a connecting post, a connecting tube, a wine spear seat, a dispenser, a wine spear, and a wine tube. The connecting post is disposed on the gas storage tank opening. The connecting post is provided with an inflating valve core for inflating the gas storage tank, a safety valve for automatically decompressing the gas storage tank and a relief valve for reducing the pressure of the gas output from the gas storage tank to a desired pressure. An outlet end of the relief valve is provided with a check valve A for triggering activation.

One end of the connecting tube is connected to the check valve A of the relief valve. Another end of the connecting tube is connected to the dispenser. The end of the connecting tube, connected to the relief valve, is provided with a relief valve contact pin for opening the check valve A at the outlet end of the relief valve. When the check valve A is closed, the gas from the gas storage tank is sealed in the relief valve. When the check valve A is opened, the gas in the gas storage tank flows out through the relief valve to enter the connecting tube.

The end of the connecting tube, connected to the dispenser, is provided with a check valve B for triggering activation. When the check valve B is closed, the gas passing through the relief valve is sealed in the connecting tube. When the check valve B is opened, the gas in the connecting tube flows out through the check valve B to enter the dispenser.

The wine spear seat is disposed on the alcoholic beverage barrel opening. The dispenser is installed above the wine spear seat. The wine spear is installed below the wine spear seat.

The dispenser is provided with a piston which triggers the opening of the check valve B of the connecting tube and the opening of the wine spear in the alcoholic beverage barrel, and a press rod cam for controlling the piston to move up and down.

In the aforesaid technical solution, the connecting post is fixed on the gas storage tank, used as a connecting carrier. The relief valve is a pressure reducing valve with a certain reduction ratio of the inlet pressure and the outlet pressure.

In the aforesaid technical solution, the wine spear is a wine outlet valve installed in the alcoholic beverage barrel. The wine spear is a standard wine spear assembly, which cooperates with other components to realize that the gas in the gas storage tank is injected into the alcoholic beverage barrel for the alcoholic beverage to flow out. The standard wine spear assembly can be purchased in the market. The advantage of using a standard wine spear assembly is that the alcoholic beverage barrel can be cleaned and disinfected by using standard washing equipment before filling the liquid beverage, and the alcoholic beverage barrel can be filled with the liquid beverage by using a standard filling machine and can be sealed after filling.

In the aforesaid technical solution, before filling the gas, the connecting tube is not installed on the fresh-keeping barrel of the present invention. The gas storage tank is filled with the gas through the inflating valve core on the connecting post. In the process of filling the gas, the setting of the safety valve can play the role of pressure limit and anti-explosion.

After the gas filling is completed, the check valve A is provided at the outlet end of the relief valve so that the filled gas can be blocked in the relief valve. After the gas filling is completed, the connecting tube is installed. Firstly, the connecting tube is connected with the relief valve. Because one end of the connecting tube, connected with the relief valve, is provided with the relief valve contact pin, the relief valve contact pin just opens the check valve A when connected, such that the gas in the gas storage tank enters the connecting tube through the relief valve. Since the other end of the connecting tube is not provided with the check valve B, the gas entering the connecting tube through the relief valve is blocked in the check valve B. Then, one end of the connecting tube, having the check valve B, is connected to the dispenser. The stroke of the piston is controlled by the movement of the cam of the press rod. When the piston moves to a certain position, the piston of the dispenser touches and opens the check valve B of the connecting tube so that the gas in the gas storage tank enters the dispenser through the check valve B and enters the alcoholic beverage barrel. When the pressure in the alcoholic beverage barrel continues to increase, the wine is pressurized to flow out from the liquid outlet end of the dispenser.

The relief valve includes a relief valve seat, a relief valve core and a relief valve bonnet which are sequentially arranged along an inlet end toward the outlet end thereof. The relief valve bonnet is provided with a relief valve outlet hole and an open cavity facing the outlet end. The open cavity is configured to receive the end having the relief valve contact pin of the connecting tube. The check valve A includes a check valve body A. The inside of the check valve body A is provided with a check valve core A for closing or opening the outlet hole and a check valve return spring A for returning the check valve core A. The check valve core A has a force action portion A to which a force can be applied.

When the relief valve is mounted on the connecting post and the force action portion A is in a free state without being applied with a force, and the check valve core A is in contact with the relief valve outlet hole so that the gas in the gas storage tank is sealed in the relief valve.

When the end having the relief valve contact pin of the connecting tube is inserted into the open cavity for the connecting tube to be connected with the relief valve, the relief valve contact pin of the connecting tube applies a force to the force action portion A in the direction from the outlet end toward the inlet end of the relief valve. The check valve core A is disengaged from the relief valve outlet hole so that the relief valve outlet hole is opened. At this time, the check valve A is opened, the high-pressure gas in the gas storage tank flows through the connecting post and the relief valve to the connecting tube.

The check valve core A includes a sealing gasket, a top rod, and a check valve shutter body. The check valve shutter body is in the form of a stepped cylindrical structure and is provided with a small-diameter trough and a large-diameter annular trough. The top rod is inserted into the small-diameter trough after passing through a central hole of the sealing gasket. One end face of the sealing gasket is fixed in the large-diameter annular trough, and another end face is in contact with the relief valve outlet hole.

The check valve return spring A is sleeved on an outer periphery of the check valve core A. One end of the check valve return spring A abuts against an inner bottom surface of the check valve body A, and another end abuts against a stepped outer periphery of the check valve shutter body.

The top rod of the check valve core A includes a head portion and a rod portion. The head portion of the top rod is raised to form the force action portion A. The head portion of the top rod passes through the relief valve outlet hole of the relief valve bonnet. The force action portion A extends out of an outer side of the relief valve bonnet.

The relief valve is a proportional relief valve.

The connecting tube is a stainless steel bellow.

The end of the connecting tube, connected with the dispenser, is provided with a connecting tube outlet hole. The check valve body B is provided with a check valve core B therein for closing or opening the connecting tube outlet hole, and a check valve return spring B for returning the check valve core B.

The check valve core B is to contact and seal against the connecting tube outlet hole and has a force action portion B. When a force is applied to the force action portion B of the check valve core B, the check valve return spring B is compressed, the check valve core B is disengaged from the connecting tube outlet hole to open the connecting tube outlet hole.

The integrated alcoholic beverage fresh-keeping barrel system further comprises a first clamping hoop for fixing the connecting tube and the relief valve together and a second clamping hoop for fixing the connecting tube and the dispenser together.

The structure of the check valve core A is the same as that of the check valve core B.

The dispenser includes an operating device, a wine tube connecting seat and a dispenser shaft which are sequentially arranged from top to bottom. The dispenser further includes a dispenser seat surrounding the dispenser shaft. The wine tube connecting seat and the dispenser shaft constitute the piston of the dispenser.

The dispenser seat is provided with an intake end. The check valve B of the connecting tube is inserted into the intake end. The dispenser shaft is axially movably disposed along the dispenser seat. The wine tube connecting seat includes a horizontal portion and a longitudinal portion. The longitudinal portion of the wine tube connecting seat is connected to an upper end of the dispenser shaft. The horizontal portion is formed with the liquid outlet end for mounting the wine tube.

The dispenser shaft includes a dispenser shaft annular groove disposed along an axial surface thereof and a dispenser shaft longitudinal hole penetrating the dispenser shaft. The dispenser shaft annular groove has a bevel end face.

A bottom of the dispenser seat is provided with a dispenser seat sealing gasket. A lower end of the dispenser shaft is provided with a dispenser shaft sealing gasket which is synchronously moved along with the dispenser shaft.

The wine tube connecting seat is provided with a flow passage communicated with the dispenser shaft longitudinal hole and the liquid outlet end.

The operating device includes a press rod and a handle. The dispenser seat extends upward to form a bracket. A head end of the press rod is disposed on a top of the wine tube connecting seat and is hinged to the bracket of the dispenser seat. The head end of the press rod is provided with a cam which is mated with and in contact with the top of the wine tube connecting seat. When the cam is rotated, the cam presses the wine tube connecting seat down.

A rear end of the press rod is rotatably connected to the handle. The handle has a self-locking structure. When the handle is in a self-locking state, the handle and the press rod are in a firm right angle state, and the force exerted by the cam on the wine tube connecting seat is zero. When the handle is rotated for the handle and the press rod to be rigidly and linearly connected, the handle is pulled to drive the cam of the press rod to rotate.

The rear end of the press rod is formed with a notch and a counterbore step. The operating device further includes a rotating pin and a spring. The handle includes a handle hole provided with the spring. One end of the rotating pin is hinged to the notch, and another end is inserted into the spring and the handle hole. Two ends of the spring abut against the handle hole and the rotating pin, respectively. One end of the handle, located in the notch, is provided with a handle boss engaged with the counterbore step.

In the aforesaid technical solution, the handle is a rotatable handle.

When the handle boss is embedded in the counterbore step of the press rod, the handle and the cam of the press rod are rigidly linearly connected. When the handle is pulled in a direction away from the cam of the press rod, the handle boss is disengaged from the counterbore step, and then the handle is rotated downward to drive the rotating pin and the handle boss to rotate about the notch. The handle boss is biased by the spring to lean against the bottom of the press rod. The handle is pressed against the end face of the mounting seat of the dispenser to form a self-locking structure. At this time, the press rod is in a horizontal state. The cam of the press rod maintains in a basic point state. A force exerted by the cam of the press rod on the wine tube connecting seat is zero. At this time, the pressure applied to the piston is zero so the piston remains in the initial state. The check valve B of the connecting tube is closed.

When the handle is pulled up to rotate, the rotating pin is driven to rotate about the notch. After the rotating pin is rotated to a certain angle, the handle boss is embedded in the counterbore step of the press rod, so that the handle and the cam of the press rod are rigidly linearly connected. At this time, continuing to rotate the handle upward will drive the press rod to rotate upward, meanwhile, the cam of the press rod will rotate downward. During the downward rotation of the cam, the cam is in contact with the top of the wine tube connecting seat and presses the wine tube connecting seat, thereby driving the piston to move downward. When the cam rotates downward to the dead point, the dispenser shaft opens the check valve B of the connecting tube, and the liquid outlet channel of the wine spear is open. The gas from the gas storage tank enters the alcoholic beverage barrel through the check valve so that the liquid in the alcoholic beverage barrel is pressurized to flow out to get wine and beverage.

In the integrated alcoholic beverage fresh-keeping barrel system, the wine tube comprises an inner tube and an outer tube which are connected end to end. One end of the inner tube is connected to the liquid outlet end of the wine tube connecting seat. The end of the inner tube, connected to the wine tube connecting seat, is placed horizontally. The end of the inner tube, close to the wine tube connecting seat, is provided with an expanding step and an O-shaped ring. The inner tube and the wine tube connecting seat are rotatably connected through a nut. Another end of the inner tube has an inner tube bending end bent by 90 degrees. Another end of the outer tube has an outer tube bending end bent by 90 degrees. The outer tube bending end is inserted into the inner tube bending end and rotatably connected through a nut. A portion of the outer tube, inserted into the inner tube, is provided with the expanding step and the O-shaped ring. Another end of the outer tube is a wine outlet.

In the aforesaid technical solution, both the inner tube and the outer tube of the wine tube can be rotated. Therefore, when the wine is not required, the outer tube can be rotated toward the center of the fresh-keeping barrel, so that the wine tube can be collected above the fresh-keeping barrel and sealed in the sealed spaced with the cover to be protected and carried conveniently.

Compared with the prior art, the present invention has the following beneficial effects:

The cover of the present invention can be screwed with the upper opening of the housing to seal and protect the internal components (the valve core, the dispenser, etc.). The cover can also be screwed with the base of the housing to form an ice cube storage area to store ice cubes for cooling and thermal insulation, thereby ensuring the taste and flavor of the alcoholic beverage.

The connecting post of the present invention is used as a connecting carrier and installed with the inflating valve core, the safety valve for pressure limit and anti-explosion and the relief valve. On the one hand, the safety valve ensures that the internal pressure of the gas storage tank is in a safe range during the gas filling and after the gas filling; on the other hand, the relief valve reduces the gas pressure to a preset value in proportion, thereby ensuring the safety and the normal operation for getting wine.

The wine outlet end of the dispenser of the present invention is provided with the rotatable wine tube, the foldable handle, the connecting tube check valve for triggering, and the dispenser shaft for opening the wine spear in the alcoholic beverage barrel. The rotatable wine tube can be easily stored above the gas storage tank, and the cover can be used to seal the wine tube in the sealed space. The foldable handle has a self-locking function, which can be in a stable state. In this state, the handle and the press rod are stable at a right angle, preventing the handle from being touched and rotated accidentally. Therefore, the handle won't be operated or collided accidentally during transportation to cause the outflow of wine.

In the present invention, the carbon dioxide gas storage tank is connected with the dispenser of the alcoholic beverage barrel through the relief valve. When the dispenser is opened, the carbon dioxide is filled into the alcoholic beverage barrel to discharge the wine for drinking immediately.

The present invention may be widely applied to various parties, sports competitions, catering, banquet, outdoor tourism, and other places.

Figure 1:
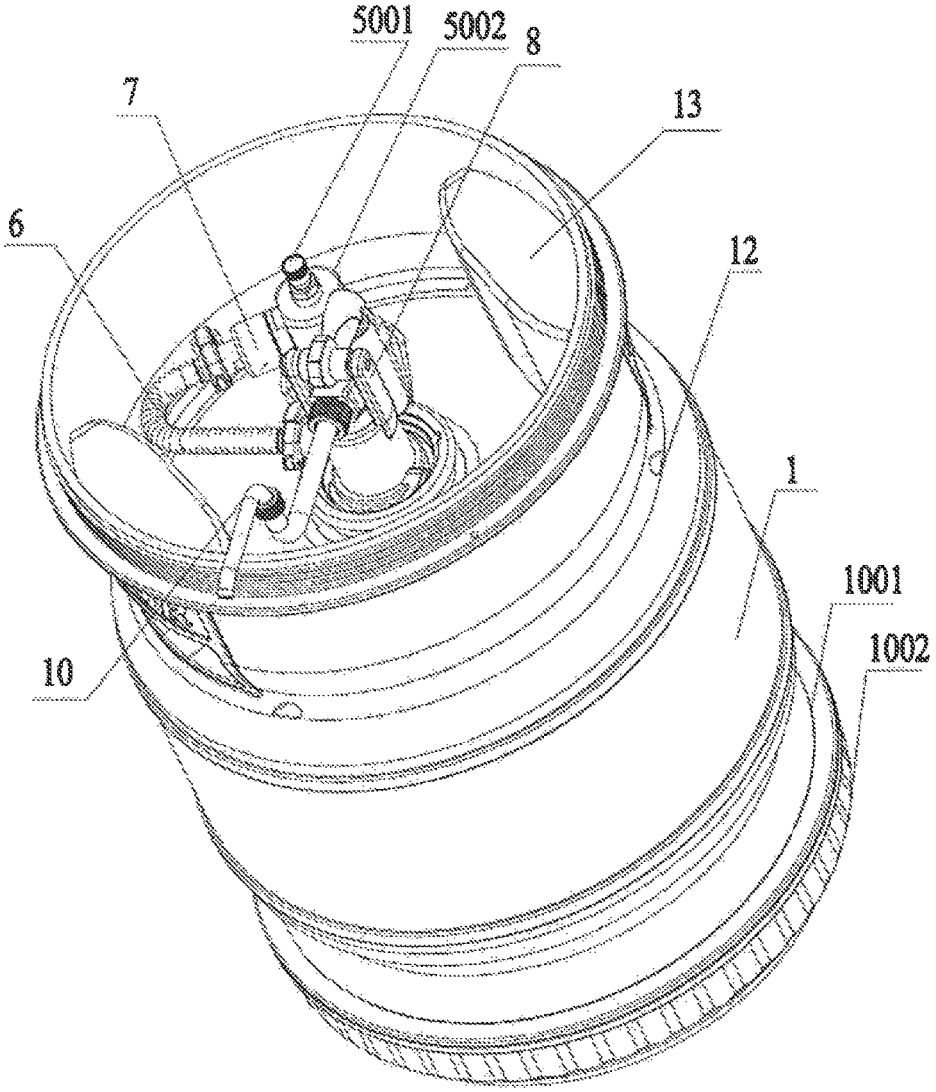
FIG. 1 is a perspective view of the integrated alcoholic beverage fresh-keeping barrel in a non-working state of the present invention (the dispenser is in a self-locking state, the wine tube is in an unfolded state, and the cover is connected to the base)
Figure 2:
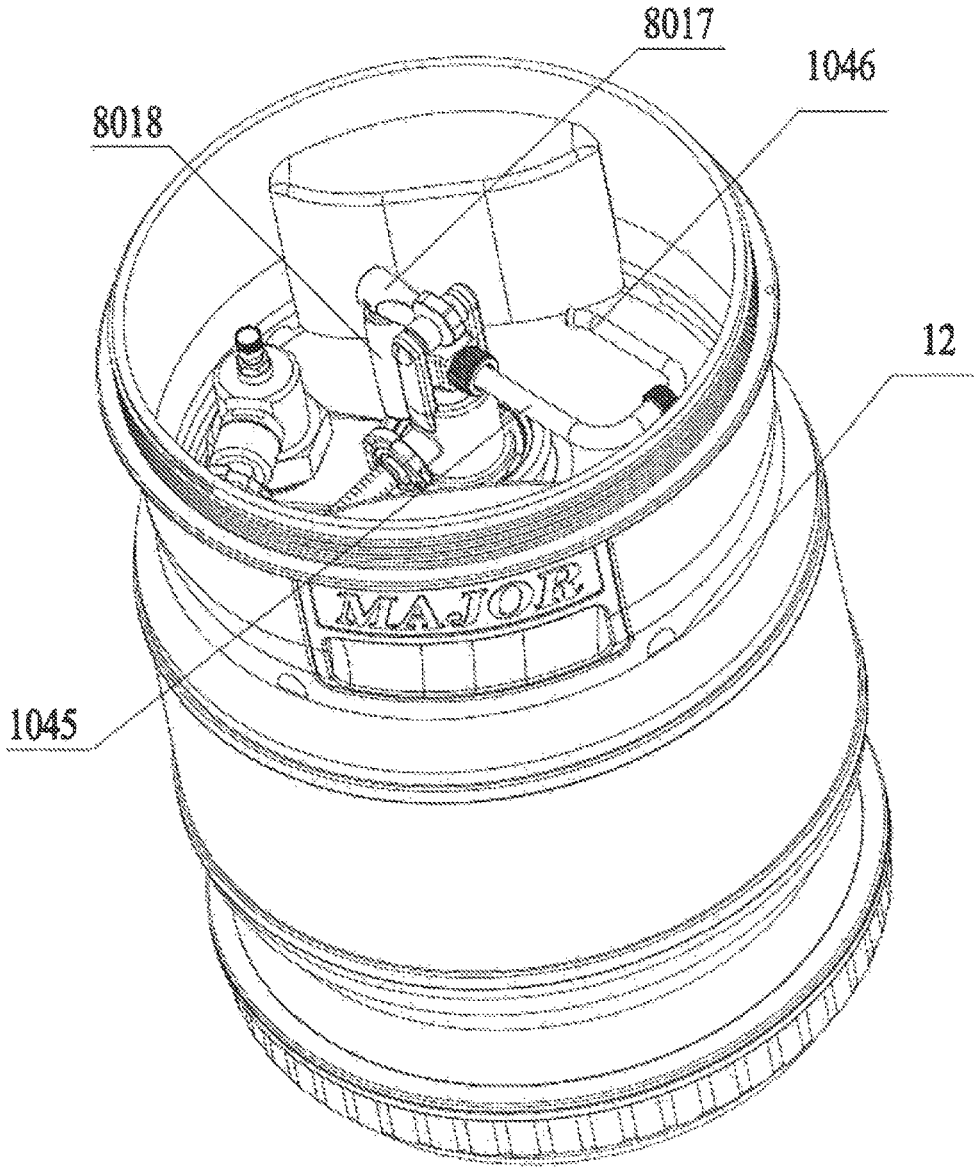
FIG. 2 is a perspective view of the integrated alcoholic beverage fresh-keeping barrel in a non-working state of the present invention (the dispenser is in a self-locking state, the wine tube is in a folded state, and the cover is connected to the base)
Figure 3:
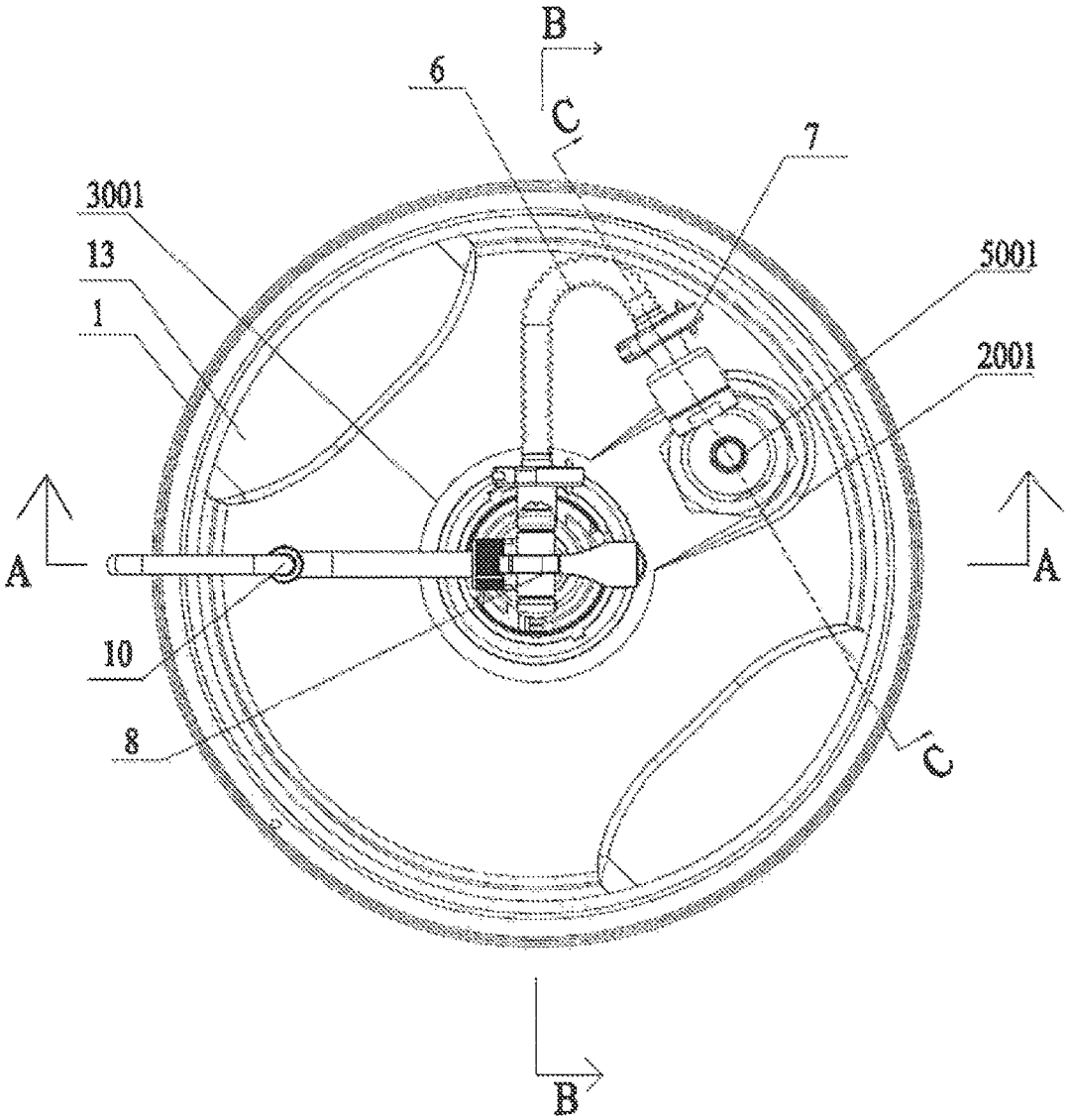
FIG. 3 is a top view of FIG. 1.
Figure 4:
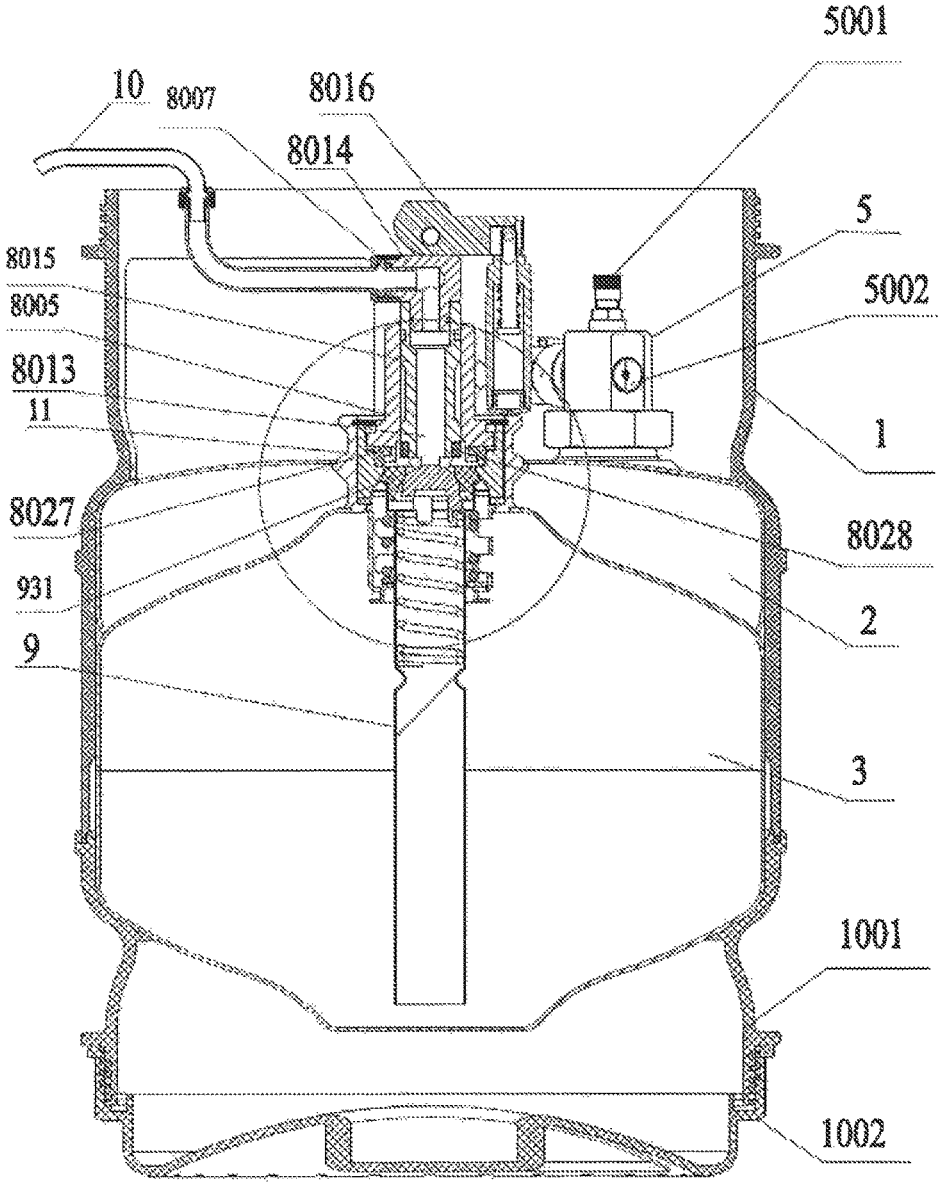
FIG. 4 is a sectional view taken along line A-A of FIG. 3.
Figure 5:
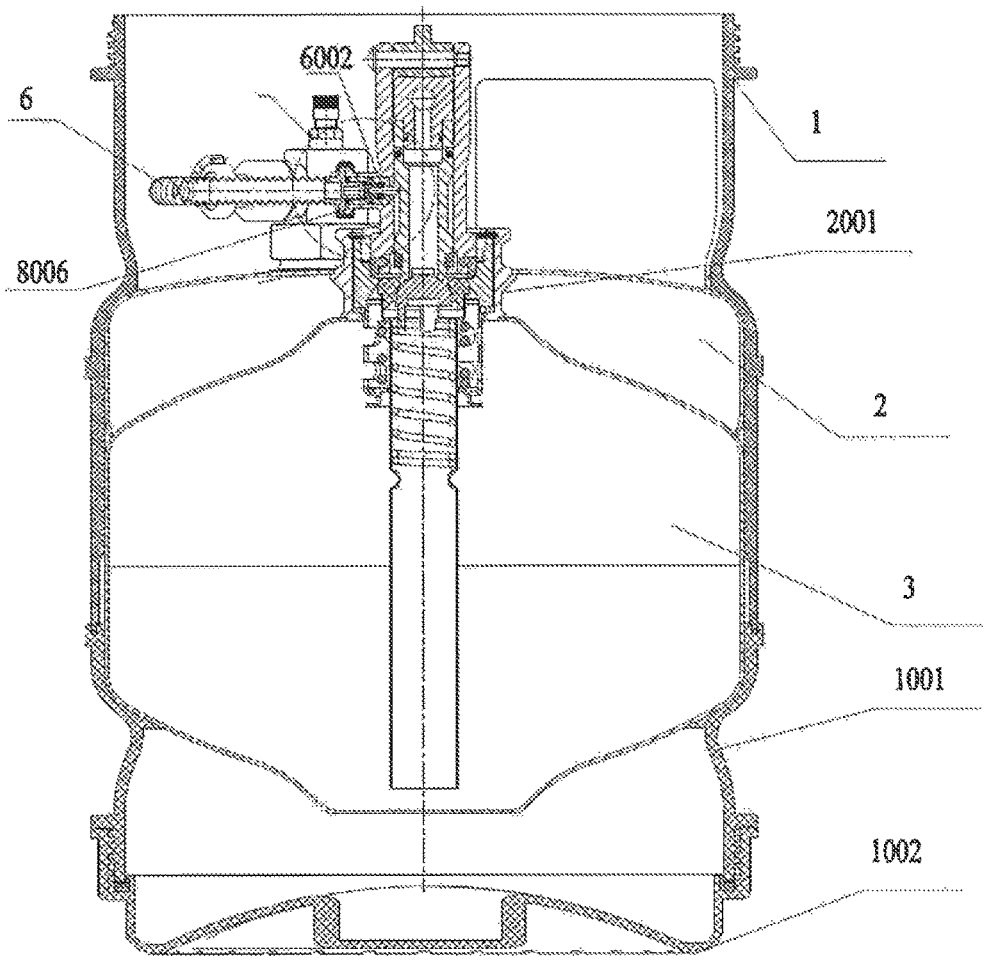
FIG. 5 is a sectional view taken along line B-B of FIG. 3.
Figure 6:
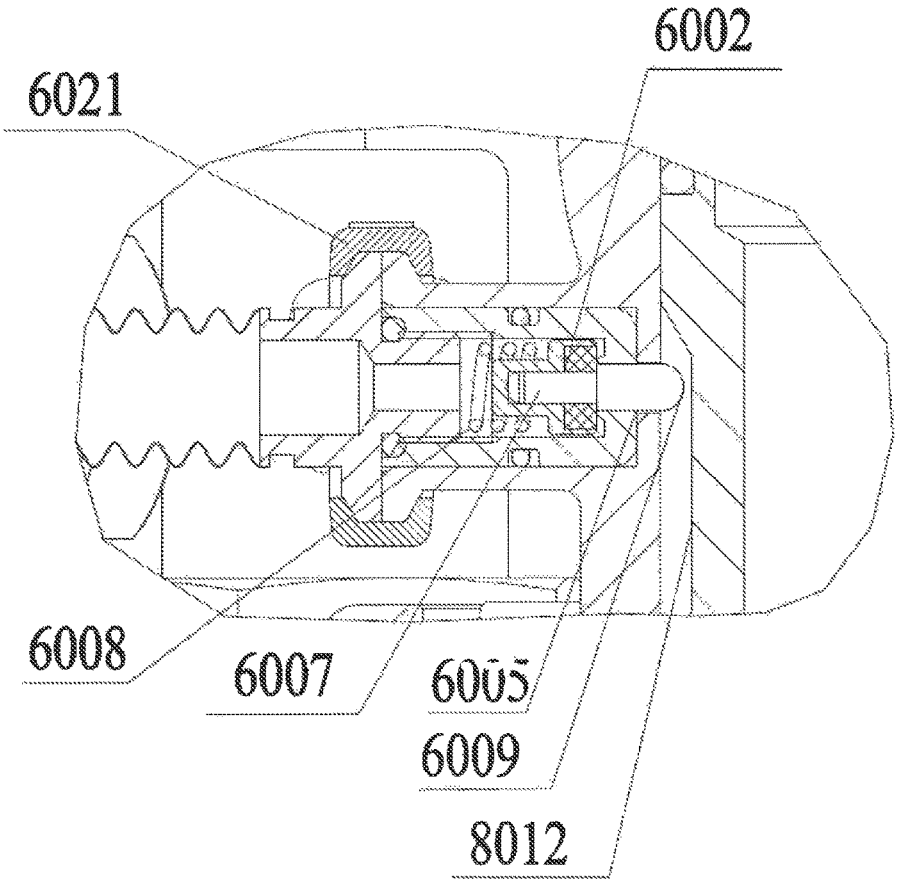
FIG. 6 is a partial enlarged view of FIG. 5 (showing the relationship between the dispenser and the connecting tube, non-working)
Figure 7:
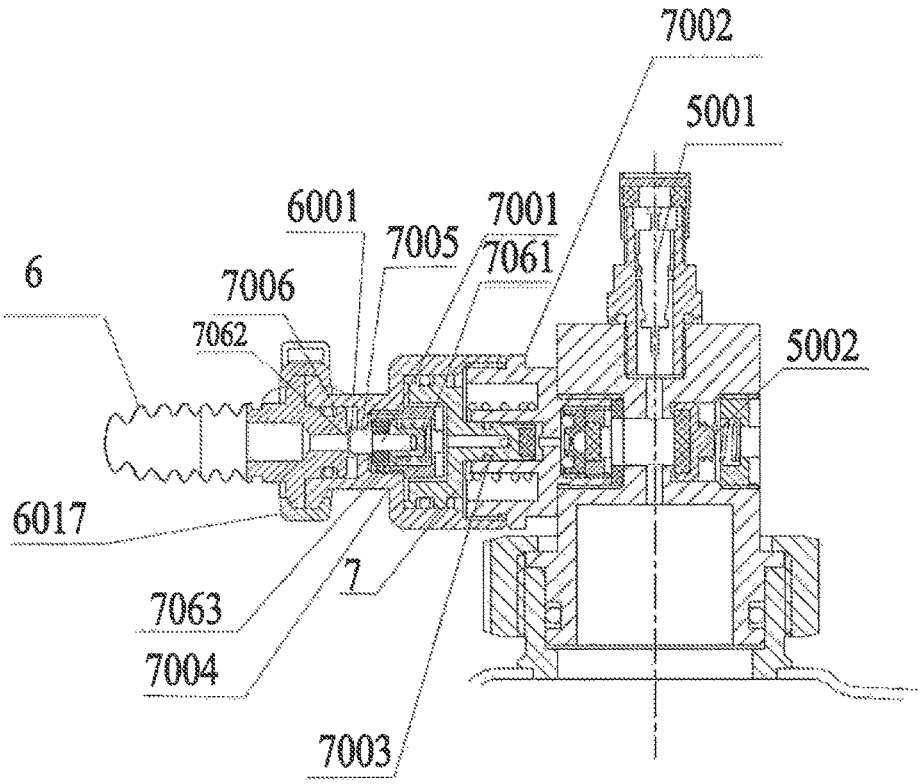
FIG. 7 is a partial enlarged view taken along line C-C of FIG. 3 (showing the relationship between the connecting tube, the relief valve and the connecting post)
Figure 8:
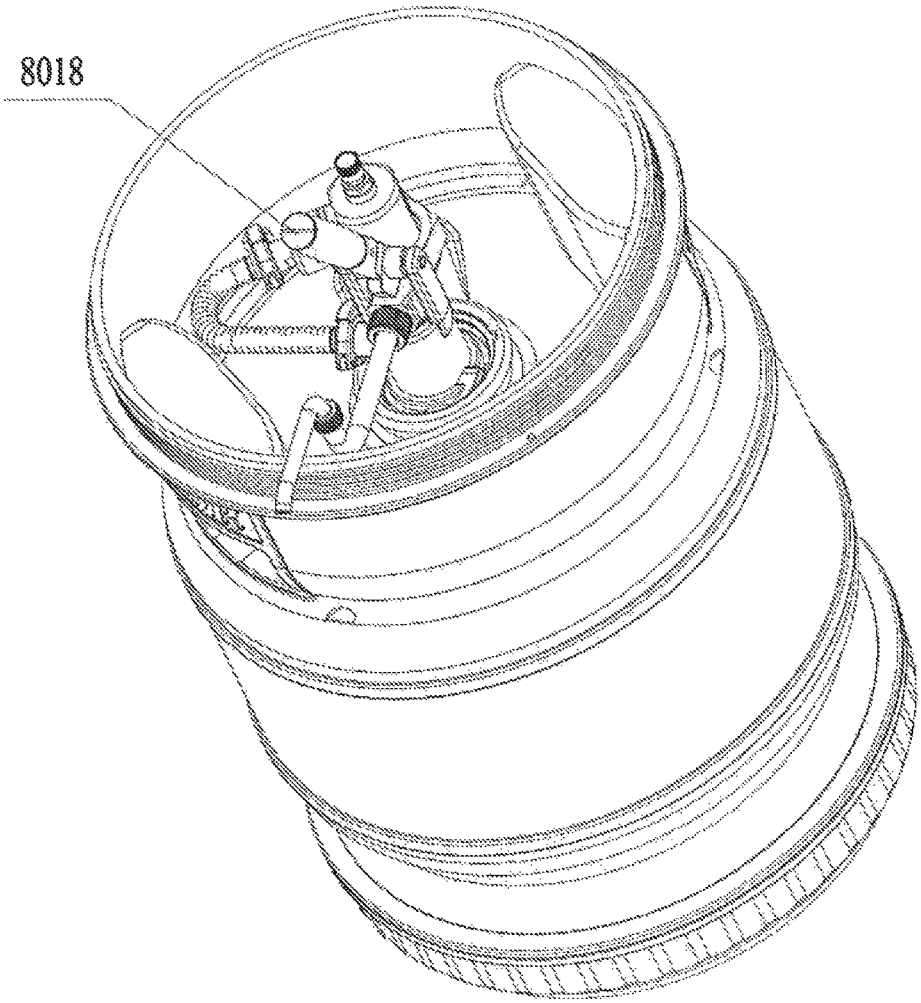
FIG. 8 is a perspective view of the present invention in a working state (the handle and the press rod are rigidly and linearly connected, the wine tube is in an unfolded state, and the cover is connected to the base)
Figure 9:
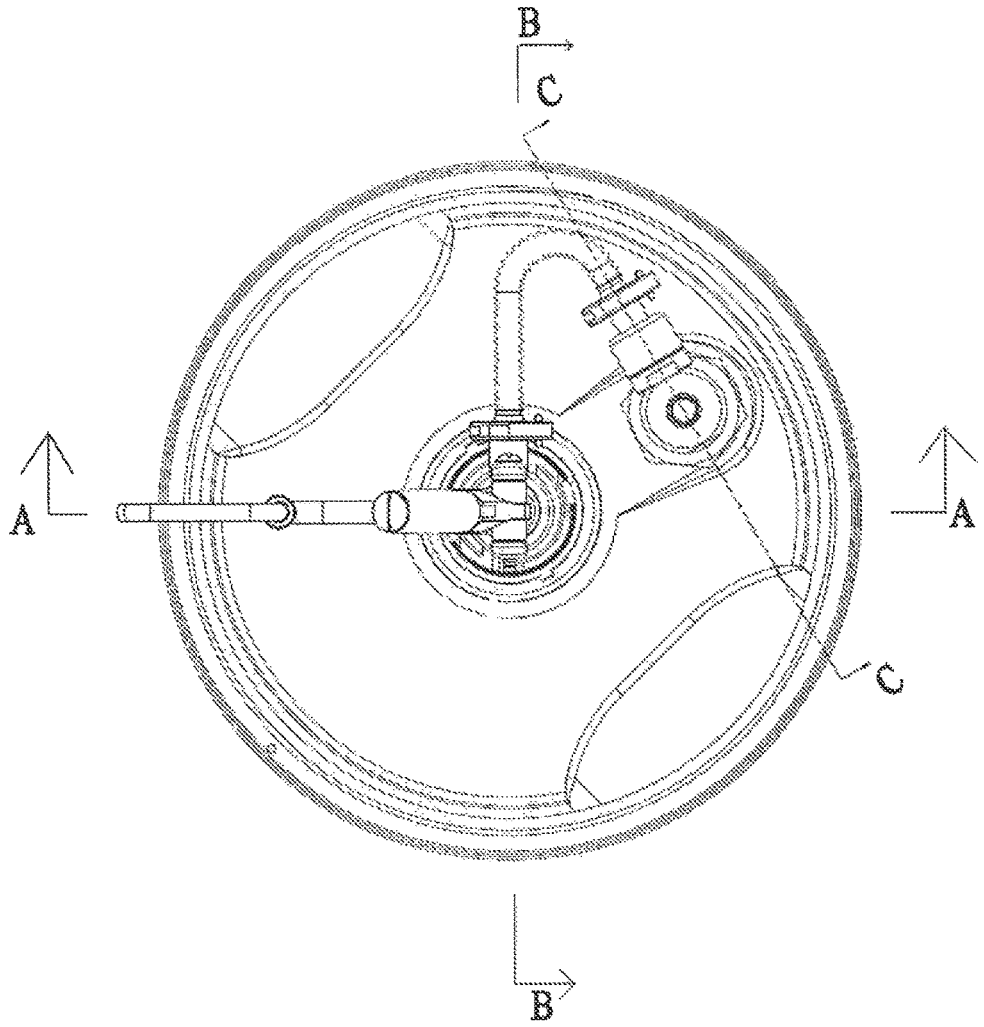
FIG. 9 is a top view of FIG. 8.
Figure 10:
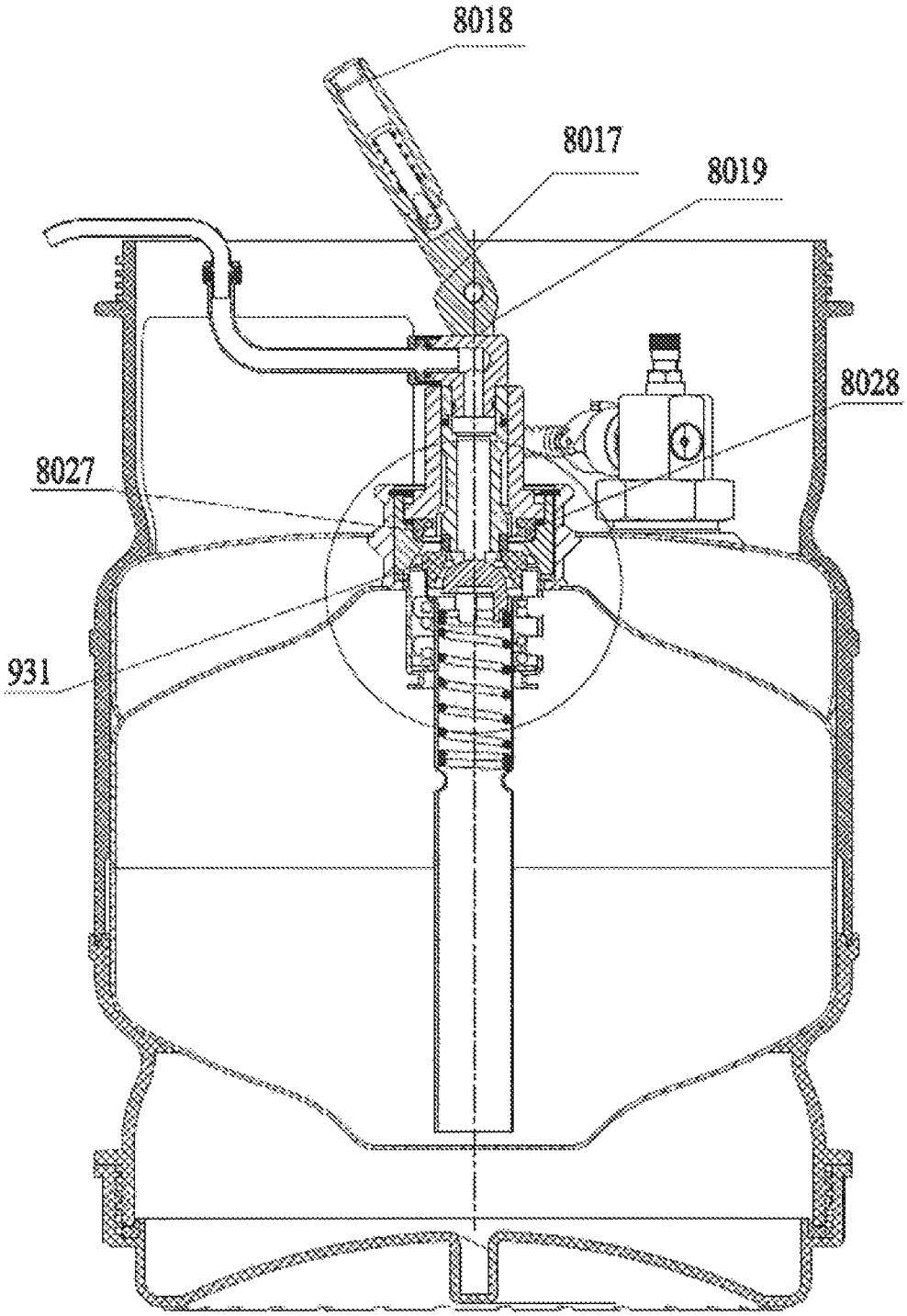
FIG. 10 is a sectional view taken along line A-A of FIG. 9.
Figure 11:
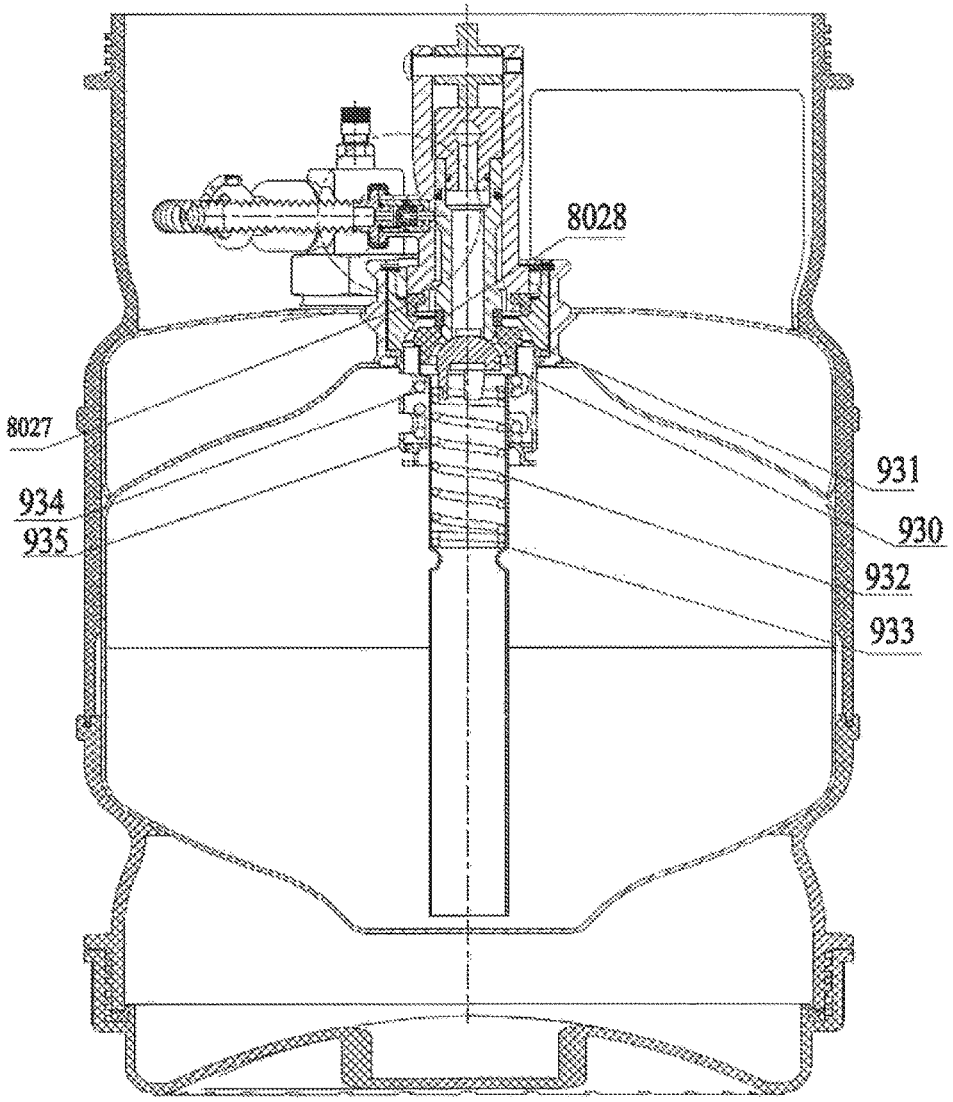
FIG. 11 is a sectional view taken along line B-B of FIG. 9.
Figure 12:
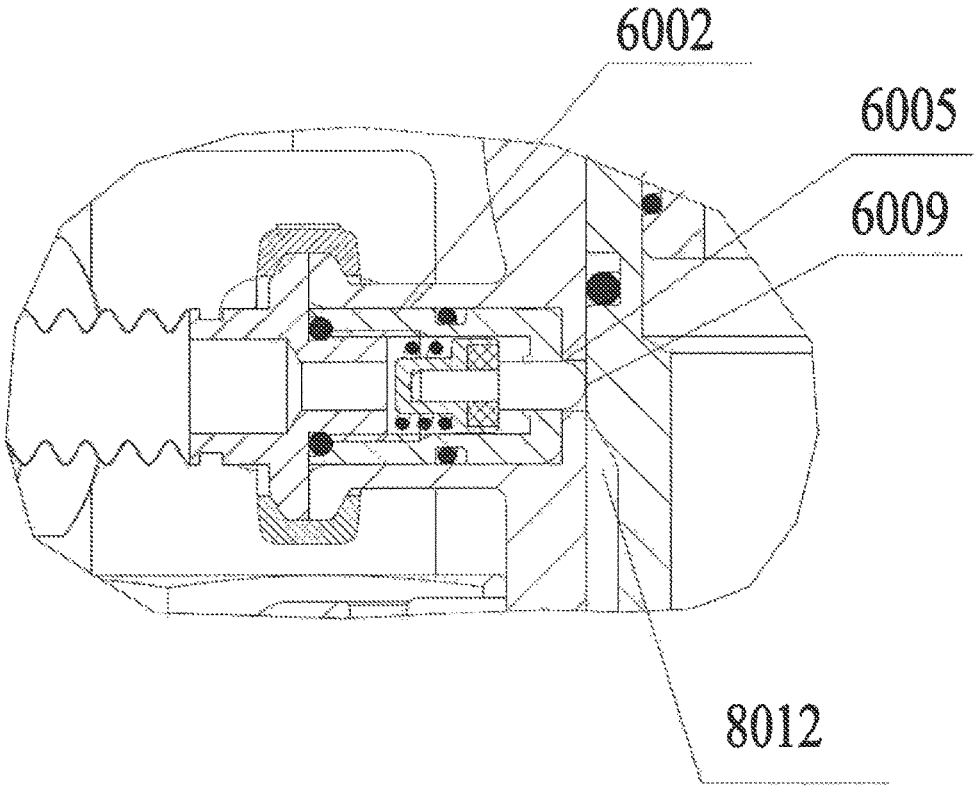
FIG. 12 is a partial enlarged view of FIG. 11.

In the figures, the respective reference numerals of the corresponding parts are: (1) housing; (1001) base; (1002) cover; (2) gas storage tank; (2001) gas storage tank opening; (3) alcoholic beverage barrel; (3001) alcoholic beverage barrel opening; (5) connecting post; (5001) inflating valve core; (5002) safety valve; (6) connecting tube; (6001) relief valve contact pin; (6002) check valve B; (6005) connecting tube outlet hole; (6007) check valve core B; (6008) check valve return spring B; (6009) force action portion B; (6017) first clamping loop; (6021) second clamping loop; (7) relief valve; (7001) check valve A; (7002) relief valve seat; (7003) relief valve core; (7004) relief valve bonnet; (7005) relief valve outlet hole; (7006) open cavity; (7027) valve sealing gasket; (7061) check valve body A; (7062) force action portion A; (7063) check valve core A; (7064) check valve return spring A; (7065) sealing gasket; (7066) top rod; (7067) check valve shutter body; (7068) small-diameter trough; (7069) large-diameter annular trough; (8) dispenser; (8016) operating device; (8014) wine tube connecting seat; (8015) dispenser shaft; (8005) dispenser seat; (8006) intake end; (8007) liquid outlet end; (8012) dispenser shaft annular groove; (8013) dispenser shaft longitudinal hole; (8027) dispenser seat sealing gasket; (8028) dispenser shaft sealing gasket; (8017) press rod; (8018) handle; (8019) cam; (8020) notch; (8021) counterbore step; (8022) rotating pin; (8023) spring; (8024) handle hole; (8025) handle boss; (9) wine spear; (930) wine spear top block; (931) wine spear intake sealing gasket; (932) internal tube spring; (933) internal tube; (934) external tube spring; (935) external tube; (10) wine tube; (1045) inner tube; (1046) outer tube; (1047)

expanding step; (1048) O-shaped ring; (1049) nut; (1050) nut; (1051) wine outlet; (11) wine spear seat

DESCRIPTION OF THE PREFERRED EMBODIMENTS

In order to understand the present invention, embodiments of the present invention will now be described, by way of example only, with reference to the accompanying drawings. It should be understood that these embodiments are only for further description of the present invention, and are not intended to limit the scope of the present invention. In addition, it should be understood that, after reading the description of the present invention, those skilled in the art make some non-essential modifications or adjustments to the present invention, which still falls within the protection scope of the present invention.

First Embodiment

As shown in FIG. 1 to FIG. 12, an integrated alcoholic beverage fresh-keeping barrel system comprises a housing 1 and an inner container wrapped by the housing 1. The inner container is divided into two layers, and comprises a gas storage tank 2 located at the upper layer for storing a gas and an alcoholic beverage barrel 3 located at the lower layer for storing a liquid beverage. The gas storage tank and the alcoholic beverage barrel are coaxially arranged one above the other, and are connected by soldering to be one-piece.

Two sides of the housing are provided with armrest recesses 13, which is convenient for the operator to carry. The side wall of the housing 1 may be provided with a plurality of anti-overflow holes 12 for wine overflow.

A base 1001 is formed below the housing 1. The alcoholic beverage fresh-keeping barrel system further includes a cover 1002. The upper part of the cover may be provided with ribs for gripping conveniently.

An upper end of the housing 1 is provided with a thread for mating and connecting with the cover 1002. A lower end of the base 1001 is also provided with a thread for mating and connecting with the cover 1002. When the cover 1002 is mated and connected with the housing 1, a sealed space is formed between the cover 1002 and the container and located above the gas storage tank 2. When the cover 1002 is mated and connected with the base 1001, a sealed space is formed between the cover 1002 and the container and located beneath the alcoholic beverage barrel 3.

The top of the alcoholic beverage barrel 3 is provided with an alcoholic beverage barrel opening 3001. A gas storage tank opening 2001 is provided above the gas storage tank 2. The position relationship between the gas storage tank 2 and the alcoholic beverage barrel 3 is that a portion of an outer surface of an upper portion of the alcoholic beverage barrel forms a bottom surface of the gas storage tank.

The control system comprises a connecting post 5, a connecting tube 6, a wine spear seat 11, a dispenser 8, a wine spear 9, and a wine tube 10.

The connecting post 5 is disposed on the gas storage tank opening 2001. The connecting post 5 is provided with an inflating valve core 5001 for inflating the gas storage tank 2, a safety valve 5002 for automatically decompressing the gas storage tank 2, and a relief valve 7 for reducing the pressure of the gas output from the gas storage tank 2 to a desired pressure. An outlet end of the relief valve 7 is provided with a check valve A7001 for triggering activation.

Figure 13:
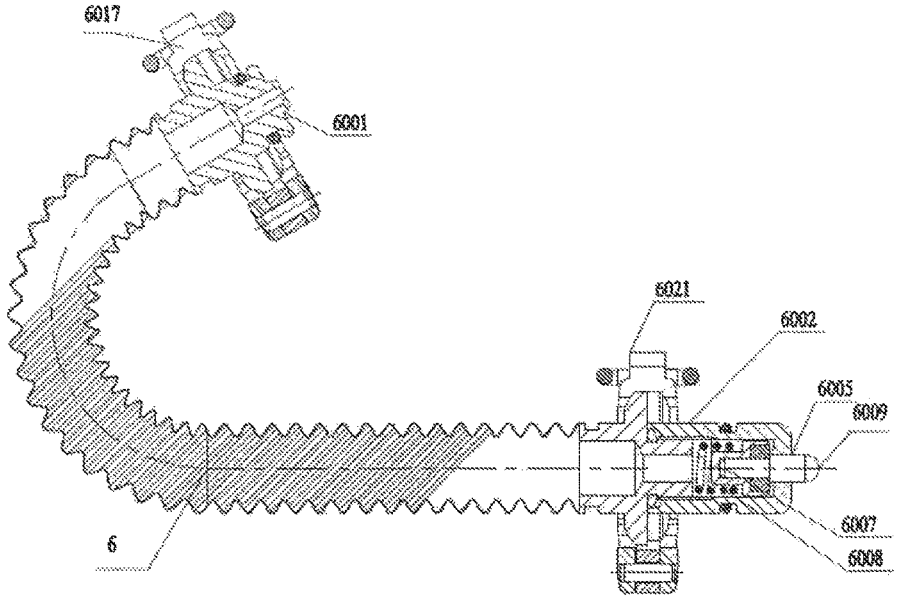
FIG. 13 is a schematic view of the connecting tube of the present invention.

As shown in FIG. 13, one end of the connecting tube 6 is connected to the check valve A7001 of the relief valve, and another end of the connecting tube 6 is connected to the dispenser 8. The end of the connecting tube 6, connected to the relief valve 7, is provided with a relief valve contact pin 6001 for opening the check valve A7001 at the outlet end of the relief valve. When the check valve A7001 is closed, the gas from the gas storage tank 2 is sealed in the relief valve 7. When the check valve A7001 is opened, the gas in the gas storage tank 2 flows out through the relief valve 7 to enter the connecting tube.

The end of the connecting tube 6, connected to the dispenser 8, is provided with a check valve B6002 for triggering activation. When the check valve B is closed, the gas passing through the relief valve is sealed in the connecting tube 6. When the check valve B is opened, the gas in the connecting tube flows out through the check valve B to enter the dispenser.

The wine spear seat 11 is disposed on the alcoholic beverage barrel opening 3001. The dispenser 8 is installed above the wine spear seat 11, and the wine spear 9 is installed below the wine spear seat 11.

The dispenser 8 is provided with a piston which triggers the opening of the check valve B6002 of the connecting tube and the opening of the wine spear 9 in the alcoholic beverage barrel, and a press rod 8017 for controlling the piston to move up and down.

Figure 14:
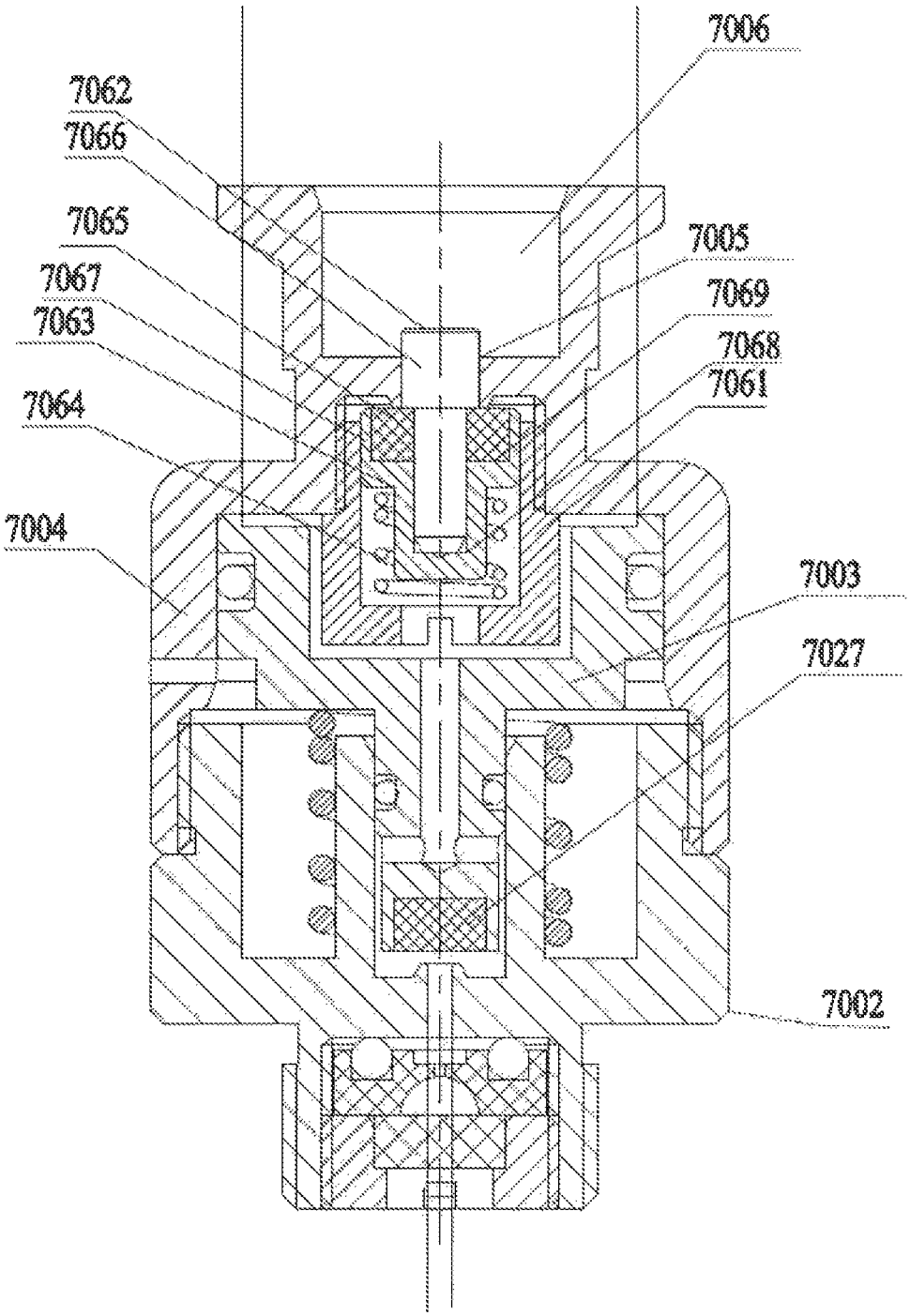
FIG. 14 is a schematic view of the relief valve of the present invention.

As shown in FIG. 14, in a specific embodiment, the relief valve 7 includes a relief valve seat 7002, a relief valve core 7003 and a relief valve bonnet 7004 which are sequentially arranged along the inlet end toward the outlet end. The relief valve bonnet 7004 is provided with a relief valve outlet hole 7005 and an open cavity 7006 facing the outlet end. The open cavity 7006 is configured to receive the end having the relief valve contact pin 6001 of the connecting tube 6. The check valve A7001 includes a check valve body A7061. The inside of the check valve body A is provided with a check valve core A7063 for closing or opening the outlet hole and a check valve return spring A7064 for returning the check valve core A7063. The check valve core A7063 has a force action portion A7062 to which a force can be applied. A valve sealing gasket 7027 is provided at the end of the relief valve core 7003. The valve sealing gasket can seal the gas inlet of the relief valve. When the relief valve load increases beyond a certain value, the valve sealing gasket 7027 seals the gas inlet of the relief valve. When the relief valve load is lowered, the valve sealing gasket 7027 is moved away from the inlet end of the relief valve by the relief valve return spring, thereby opening the gas inlet of the relief valve.

When the relief valve 7 is mounted on the connecting post 5 and the force action portion A7062 is in a free state without being applied with a force, and the check valve core A7063 is in contact with the relief valve outlet hole 7005 so that the gas in the gas storage tank 2 is sealed in the relief valve 7.

When the end having the relief valve contact pin 6001 of the connecting tube 6 is inserted into the open cavity 7006 for the connecting tube 6 to be connected with the relief valve 7, the relief valve contact pin 6001 of the connecting tube 6 applies a force to the force action portion A7062 in the direction from the outlet end of the relief valve toward the inlet end of the relief valve. The check valve core A7063 is disengaged from the relief valve outlet hole 7005 so that the relief valve outlet hole 7005 is opened. At this time, the check valve A7001 is opened, the high-pressure gas in the gas storage tank 2 flows through the connecting post 5 and the relief valve 7 to the connecting tube 6.

The check valve core A7063 includes a sealing gasket 7065, a top rod 7066, and a check valve shutter body 7067. The check valve shutter body 7067 is in the form of a stepped cylindrical structure and is provided with a small-diameter trough 7068 and a large-diameter annular trough 7069. The top rod 7066 is inserted into the small-diameter trough 7068 after passing through a central hole of the sealing gasket 7065. One end face of the sealing gasket 7065 is fixed in the large-diameter annular trough 7069, and another end face of the sealing gasket 7065 is in contact with the relief valve outlet hole 7005.

The check valve return spring A7064 is sleeved on an outer periphery of the check valve core A7063. One end of the check valve return spring A7064 abuts against an inner bottom surface of the check valve body A7061, and another end abuts against a stepped outer periphery of the check valve shutter body 7067.

The top rod 7066 of the check valve core A includes a head portion and a rod portion. The head portion of the top rod is raised to form the force action portion A7062. The head portion of the top rod passes through the relief valve outlet hole 7005 of the relief valve bonnet 7004. The force action portion A7062 extends out of an outer side of the relief valve bonnet 7004.

The end connected with the dispenser of the connecting tube 6 is provided with a connecting tube outlet hole 6005. The check valve body B6002 is provided with a check valve core B6007 therein for closing or opening the connecting tube outlet hole and a check valve return spring B6008 for returning the check valve core B6007.

The check valve core B6007 is in contact with the connecting tube outlet hole 6005 and has a force action portion B6009. When a force is applied to the force action portion B6009 of the check valve core B6007, the check valve return spring B6008 is compressed. The check valve core B6007 is disengaged from the connecting tube outlet hole 6005 to open the connecting tube outlet hole 6005.

The fresh-keeping barrel system of the present invention further comprises a first clamping hoop 6017 for fixing the connecting tube 6 and the relief valve 7 together and a second clamping hoop 6021 for fixing the connecting tube 6 and the dispenser 8 together.

The structure of the check valve core A is the same as that of the check valve core B.

Figure 15:
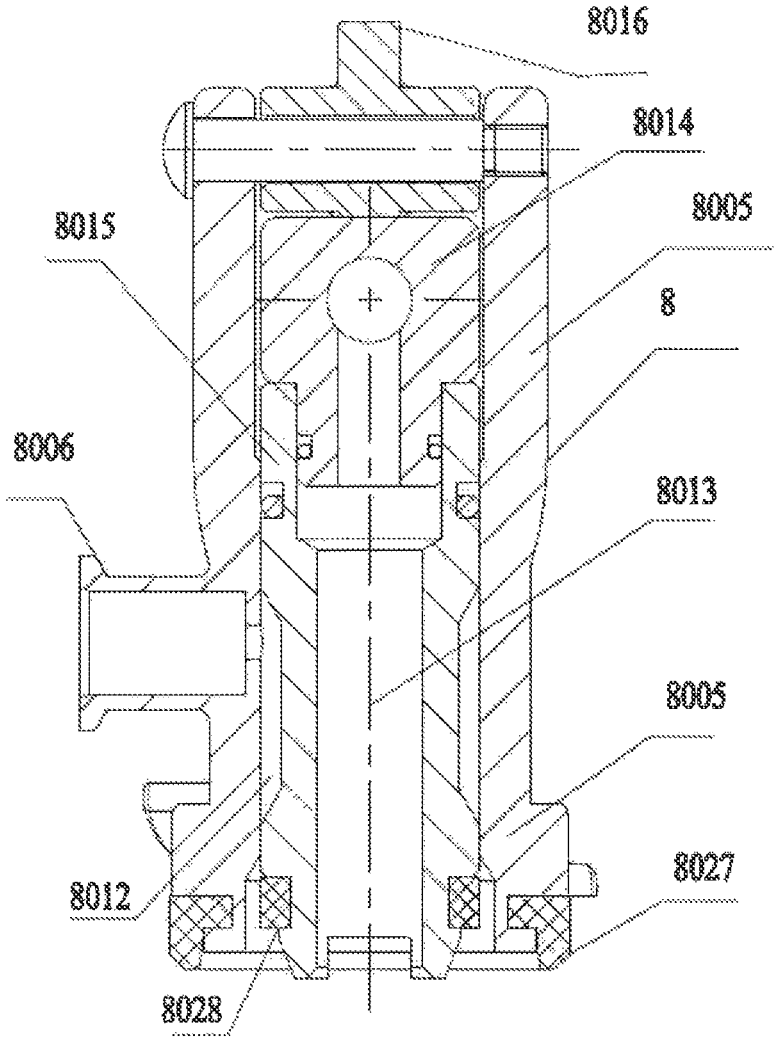
FIG. 15 and FIG. 16 are schematic views of the dispenser of the present invention.
Figure 16:
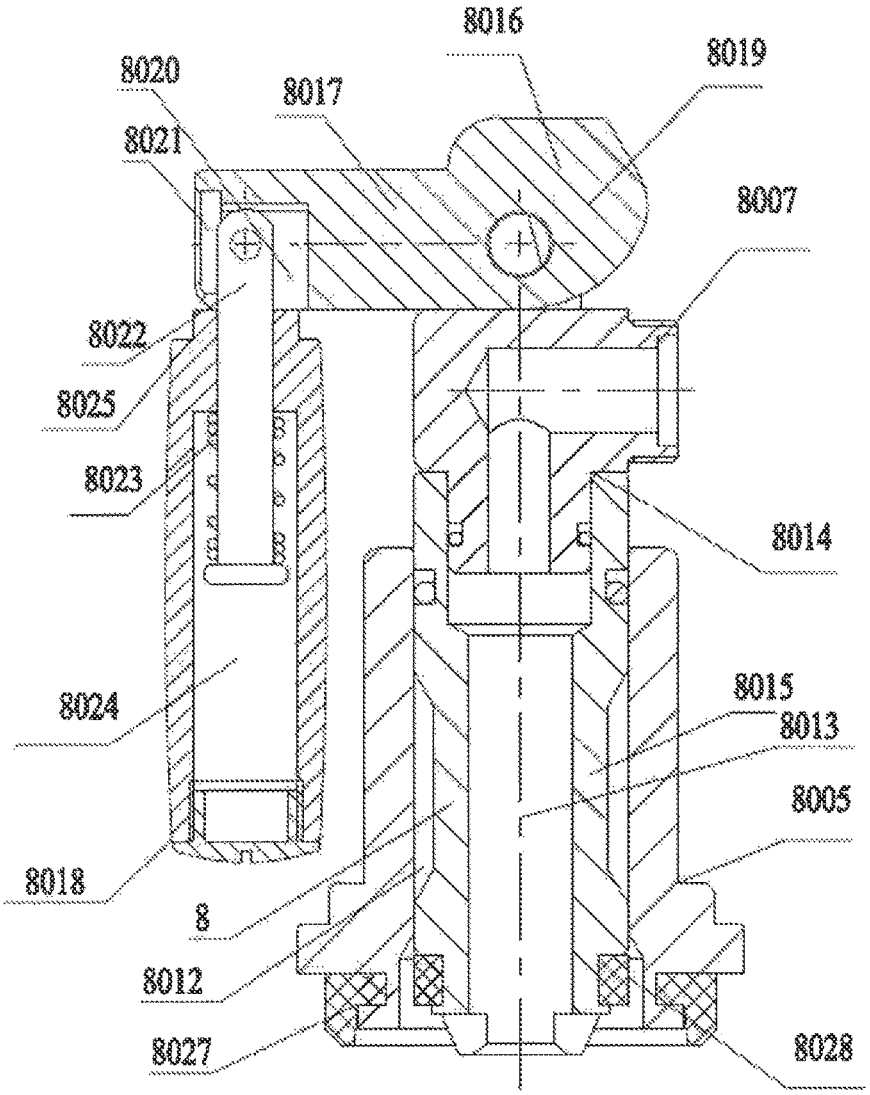

As shown in FIG. 15 and FIG. 16, the dispenser 8 includes an operating device 8016, a wine tube connecting seat 8014, and a dispenser shaft 8015 which are sequentially arranged from top to bottom. The dispenser further includes a dispenser seat 8005 surrounding the dispenser shaft 8015.

The dispenser seat 8005 is provided with an intake end 8006. The check valve B6002 of the connecting tube 6 is just inserted into the intake end 8006. The dispenser shaft 8015 is axially movably disposed along the dispenser seat 8005. The wine tube connecting seat 8014 includes a horizontal portion and a longitudinal portion. The longitudinal portion of the wine tube connecting seat 8014 is connected to an upper end of the dispenser shaft 8015. The horizontal portion is formed with a liquid outlet end 8007 for mounting a wine tube 10.

The dispenser shaft 8015 includes a dispenser shaft annular groove 8012 disposed along an axial surface and a dispenser shaft longitudinal hole 8013 penetrating the dispenser shaft 8015. The dispenser shaft annular groove 8012 has a bevel end face.

The bottom of the dispenser seat 8005 is provided with a dispenser seat sealing gasket 8027. A lower end of the dispenser shaft 8015 is provided with a dispenser shaft sealing gasket 8028 which is synchronously moved along with the dispenser shaft.

The wine tube connecting seat 8014 is provided with a flow passage communicated with the dispenser shaft longitudinal hole 8013 and the liquid outlet end 8007.

The operating device 8016 includes a press rod 8017 and a handle 8018. The dispenser seat 8005 extends upward to form a bracket. A head end of the press rod 8017 is disposed on the top of the wine tube connecting seat 8014 and is hinged to the bracket of the dispenser seat 8005. The head end of the press rod 8017 is provided with a cam 8019 which is mated with and in contact with the top of the wine tube connecting seat 8014. When the cam 8019 is rotated, the cam 8019 presses the wine tube connecting seat 8014 down.

A rear end of the press rod 8017 is rotatably connected to the handle 8018. The handle 8018 has a self-locking structure. When the handle 8018 is in a self-locking state, the handle and the press rod are in a firm right angle state and the force exerted by the cam on the wine tube connecting seat 8014 is zero. When the handle 8018 is rotated for the handle 8018 and the press rod 8017 to be rigidly and linearly connected, the handle 8018 is pulled to drive the cam 8019 to rotate.

The rear end of the press rod 8017 is formed with a notch 8020 and a counterbore step 8021. The operating device 8016 further includes a rotating pin 8022 and a spring 8023. The handle 8018 includes a handle hole 8024 provided with the spring 8023. One end of the rotating pin 8022 is hinged to the notch 8020, and another end is inserted into the spring 8023 and the handle hole 8024. Two ends of the spring 8023 abut against the handle hole 8024 and the rotating pin 8022, respectively. One end of the handle 8018, located in the notch 8020, is provided with a handle boss 8025 engaged with the counterbore step 8021.

Figure 17:
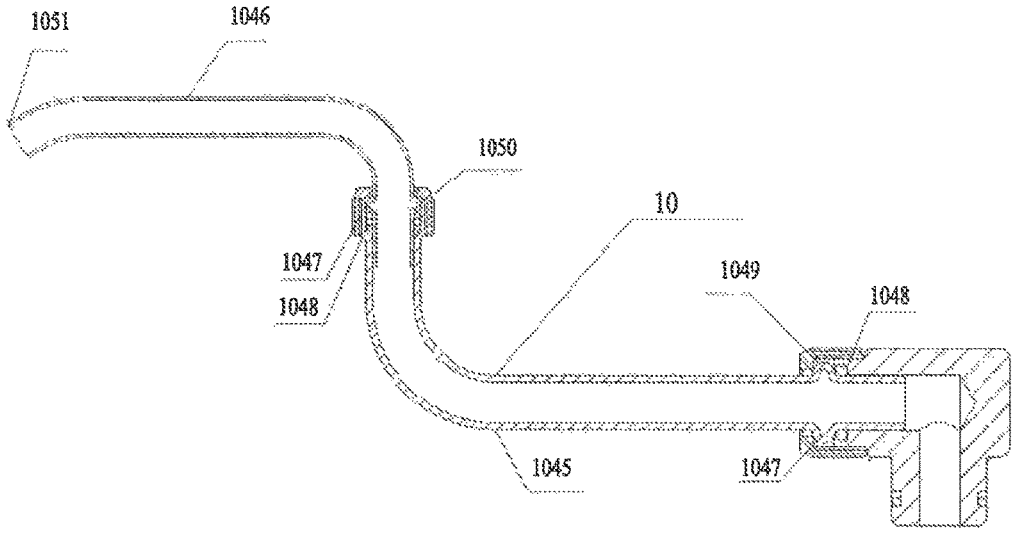
FIG. 17 is a schematic view of the wine tube of the present invention (the wine tube is in an unfolded state)

The wine tube 10 is installed at the liquid outlet end 8007 of the wine tube connecting seat 8014 and communicates with the longitudinal hole of the dispenser shaft 8015. As shown in FIG. 17, the wine tube comprises an inner tube 1045 and an outer tube 1046 which are connected end to end. One end of the inner tube is connected to the liquid outlet end 8007 of the wine tube connecting seat 8014. The end of the inner tube, connected to the wine tube connecting seat 8014, is placed horizontally. The end of the inner tube, close to the wine tube connecting seat 8014, is provided with an expanding step 1047 and an O-shaped ring 1048. The inner tube 1045 and the wine tube connecting seat 8014 are rotatably connected through a nut 1049. Another end of the inner tube 1045 has an inner tube bending end bent by 90 degrees. One end of the outer tube has an outer tube bending end bent by 90 degrees. The outer tube bending end is inserted into the inner tube bending end and rotatably connected through a nut 1050. A portion of the outer tube, inserted into the inner tube, is provided with the expanding step 1047 and the O-shaped ring 1048. Another end of the outer tube 1046 is a wine outlet 1051.

In one embodiment of the present invention, the wine spear comprises a wine spear top block 930, a wine spear intake sealing gasket 931, and an internal tube spring 932, an internal tube 933, an external tube spring 934 and an external tube 935 which are arranged from the inside out. The external tube 935 is communicated with the wine spear seat 11. The wine spear top block 930 and the wine spear intake sealing gasket 931 are disposed at the top of the internal tube 933. The bottom of the wine spear top block 930 is connected to the internal tube spring 932. The top of the wine spear top block 930 is moved upward by the internal tube spring 932 to seal the wine spear intake sealing gasket 931. The external tube spring 934 drives the internal tube 933 to move upward to seal the wine spear intake sealing gasket 31 with the external tube 935.

Figure 18:
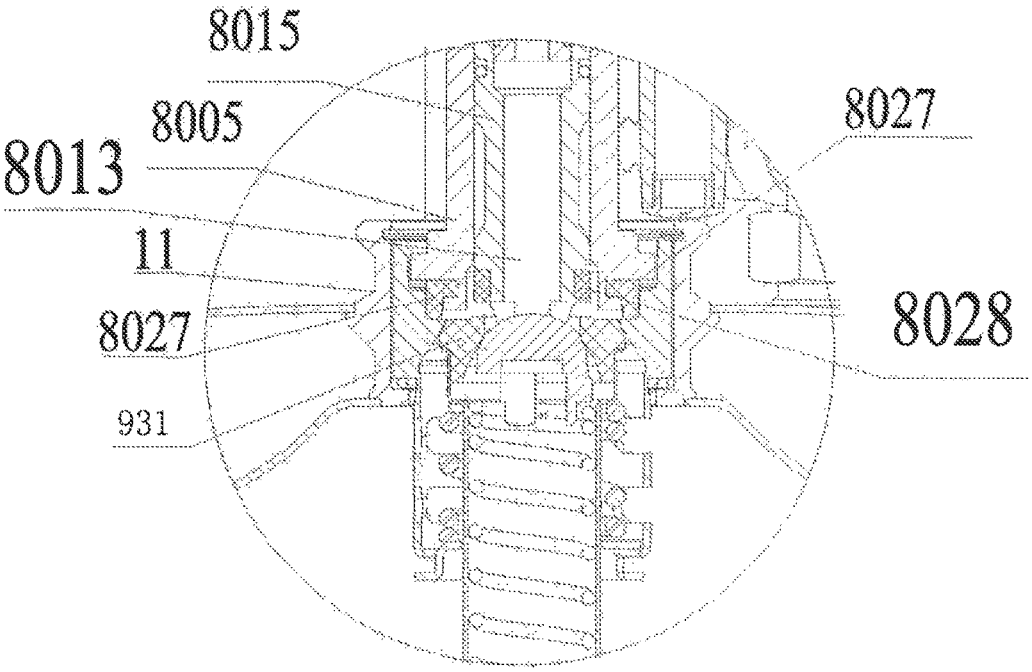
FIG. 18 is a partial enlarged view of FIG. 4.

The self-locking non-working state of the dispenser is described below. When the handle is pulled in a direction away from the cam 8019 of the press rod, the handle boss 8025 is disengaged from the counterbore step 8021, and then the handle is rotated downward to drive the rotating pin and the handle boss to rotate about the notch. The handle boss is biased by the spring to lean against the bottom of the press rod. The handle is pressed against the end face of the mounting seat of the dispenser to form a self-locking structure. At this time, the press rod is in a horizontal state. The handle is perpendicular to the press rod. The cam of the press rod maintains in a basic point state. A force exerted by the cam of the press rod on the wine tube connecting seat is zero. At this time, the dispenser shaft is in the initial state, and the dispenser shaft does not contact the check valve B of the connecting tube. Therefore, the check valve B of the connecting tube is closed and the gas in the gas storage tank is sealed in the check valve B of the connecting tube. As shown in FIG. 18, the wine spear intake sealing gasket 931 is to contact and seal against the wine spear top block 930, while the wine spear intake sealing gasket 931 is to contact and seal against the external tube 935.

Figure 19:
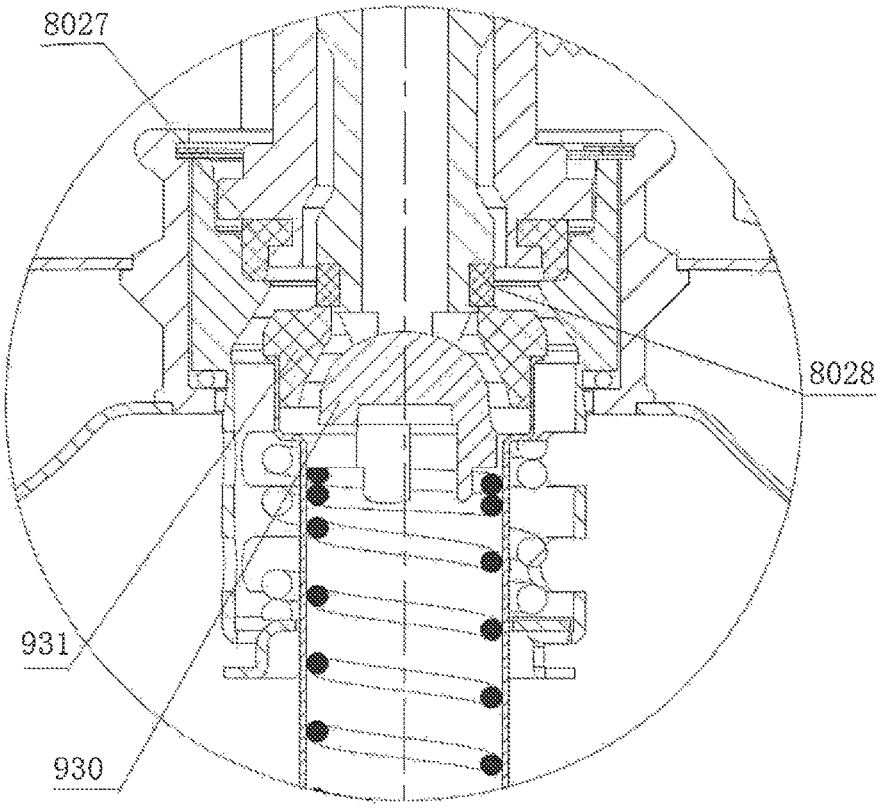
FIG. 19 is a partial enlarged view of FIG. 10.

The working state of the dispenser is described below. When the handle is pulled up to rotate, the rotating pin is driven to rotate about the notch. After the rotating pin is rotated to a certain angle, the handle boss is embedded in the counterbore step of the press rod, so that the handle and the cam of the press rod are rigidly linearly connected. At this time, continuing to rotate the handle upward will drive the press rod to rotate upward, meanwhile, the cam of the press rod will rotate downward. During the downward rotation of the cam, the cam is in contact with the top of the wine tube connecting seat and presses the wine tube connecting seat, thereby driving the dispenser shaft to move downward. When the cam rotates downward to the dead point and the dispenser shaft moves downward a certain distance, a force is applied to the check valve B through the side wall of the dispenser shaft to open the check valve B6002 of the connecting tube, meanwhile, the lower end of the dispenser shaft pushes the wine spear top block 930 and the wine spear intake sealing gasket 931 so that the wine spear intake sealing gasket 931 is disengaged from the wine spear top block 930 and the wine spear intake sealing gasket 931 is disengaged from the external tube 935. At this time, both the gas channel and the outflow liquid channel are open. As shown in FIG. 19, the gas may pass through the gap between the external tube and the wine spear intake sealing gasket 931, and the liquid may pass through the gap between the wine spear intake sealing gasket 931 and the wine spear top block 930. The gas from the gas storage tank enters the alcoholic beverage barrel through the relief valve so that the liquid in the alcoholic beverage barrel is pressurized to flow out from the gap between the wine spear top block and the wine spear intake sealing gasket to get alcoholic beverage.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An integrated alcoholic beverage fresh-keeping barrel system, characterized in that: the integrated alcoholic beverage fresh-keeping barrel system comprises a housing (1) and an inner container wrapped by the housing (1), the inner container is divided into two layers, comprising a gas storage tank (2) located at an upper layer for storing a gas and an alcoholic beverage barrel (3) located at a lower layer for storing a liquid beverage; the gas storage tank (2) and the alcoholic beverage barrel (3) are coaxially arranged one above the other;

a gas channel that can be opened and closed is provided between the gas storage tank (2) and the alcoholic beverage barrel (3); the alcoholic beverage barrel (3) is provided with a liquid outlet end and an outflow liquid channel for opening and closing the liquid outlet end; a control system is provided above the gas storage tank; the control system controls the opening and closing of the gas channel and performs linkage control on the opening and closing of the outflow liquid channel;

wherein the control system is provided with an actuating member for performing an action, the actuating element has a self-locking structure, when the actuating element is in a self-locking state, the gas channel is disconnected and the outflow liquid channel is closed;

when a first action is performed on the control system, the gas channel is connected and the outflow liquid channel is open and the gas storage tank (2) pressurizes the alcoholic beverage barrel (3); when the alcoholic beverage barrel (3) reaches a certain pressure, the liquid in the alcoholic beverage barrel flows out from the liquid outlet end;

when a second action is performed on the control system, the gas channel is disconnected and the outflow liquid channel is closed;

when a third action is performed on the control system, the control system is in a self-locking state, the gas channel is disconnected and the outflow liquid channel is closed.

2. The integrated alcoholic beverage fresh-keeping barrel system as claimed in claim 1, wherein a base (1001) is formed below the housing (1); the alcoholic beverage fresh-keeping barrel system further comprises a cover (1002), an upper end of the housing (1) is provided with a feature connecting portion for mating and connecting with the cover (1002), a lower end of the base (1001) is provided with another feature connecting portion for mating and connecting with the cover (1002);

when the cover (1002) is mated and connected with the housing (1), a sealed space is formed between the cover (1002) and the container and located above the gas storage tank (2);

when the cover (1002) is mated and connected with the base (1001), another sealed space is formed between the cover (1002) and the container and located beneath the alcoholic beverage barrel (3).

3. The integrated alcoholic beverage fresh-keeping barrel system as claimed in claim 1, wherein the gas storage tank (2) and the alcoholic beverage barrel (3) are connected together by soldering.

4. The integrated alcoholic beverage fresh-keeping barrel system as claimed in claim 3, wherein a top of the alcoholic beverage barrel (3) is provided with an alcoholic beverage barrel opening (3001); a gas storage tank opening (2001) is provided above the gas storage tank (2); a position relationship between the gas storage tank (2) and the alcoholic beverage barrel (3) is that a portion of an outer surface of an upper portion of the alcoholic beverage barrel forms a bottom surface of the gas storage tank.

5. The integrated alcoholic beverage fresh-keeping barrel system as claimed in claim 4, wherein the control system comprises a connecting post (5), a connecting tube (6), a wine spear seat (11), a dispenser (8), a wine spear (9), and a wine tube (10);

the connecting post (5) is disposed on the gas storage tank opening (2001), the connecting post (5) is provided with an inflating valve core (5001) for inflating the gas storage tank (2), a safety valve (5002) for automatically decompressing the gas storage tank (2) and a relief valve (7) for reducing the pressure of the gas output from the gas storage tank (2) to a desired pressure; an outlet end of the relief valve (7) is provided with a check valve A(7001) for triggering activation;

one end of the connecting tube (6) is connected to the check valve A(7001) of the relief valve, another end of the connecting tube (6) is connected to the dispenser (8); the end of the connecting tube (6), connected to the relief valve (7), is provided with a relief valve contact pin (6001) for opening the check valve A(7001) at the outlet end of the relief valve, when the check valve A(7001) is closed, the gas from the gas storage tank (2) is sealed in the relief valve (7), when the check valve A(7001) is opened, the gas in the gas storage tank (2) flows out through the relief valve (7) to enter the connecting tube;

the end of the connecting tube (6), connected to the dispenser (8), is provided with a check valve B(6002) for triggering activation; when the check valve B is closed, the gas passing through the relief valve is sealed in the connecting tube (6), when the check valve B is opened, the gas in the connecting tube flows out through the check valve B to enter the dispenser;

the wine spear seat (11) is disposed on the alcoholic beverage barrel opening (3001), the dispenser (8) is installed above the wine spear seat (11), the wine spear (9) is installed below the wine spear seat (11);

the dispenser (8) is provided with a piston which triggers the opening of the check valve B(6002) of the connecting tube and the opening of the wine spear (9) in the alcoholic beverage barrel and a press rod (8017) for controlling the piston to move up and down.

6. The integrated alcoholic beverage fresh-keeping barrel system as claimed in claim 5, wherein the relief valve (7) includes a relief valve seat (7002), a relief valve core (7003) and a relief valve bonnet (7004) which are sequentially arranged along an inlet end toward the outlet end thereof, the relief valve bonnet (7004) is provided with a relief valve outlet hole (7005) and an open cavity (7006) facing the outlet end, the open cavity (7006) is configured to receive the end having the relief valve contact pin (6001) of the connecting tube (6); the check valve A(7001) includes a check valve body A(7061); an inside of the check valve body A is provided with a check valve core A(7063) for closing or opening the outlet hole and a check valve return spring A(7064) for returning the check valve core A(7063), the check valve core A(7063) has a force action portion A(7062) to which a force can be applied;

when the relief valve (7) is mounted on the connecting post (5) and the force action portion A(7062) is in a free state without being applied with a force, and the check valve core A(7063) is in contact with the relief valve outlet hole (7005) so that the gas in the gas storage tank (2) is sealed in the relief valve (7);

when the end having the relief valve contact pin (6001) of the connecting tube (6) is inserted into the open cavity (7006) for the connecting tube (6) to be connected with the relief valve (7), the relief valve contact pin (6001) of the connecting tube (6) applies a force to the force action portion A(7062) in the direction from the outlet end toward the inlet end of the relief valve, the check valve core A(7063) is disengaged from the relief valve outlet hole (7005) so that the relief valve outlet hole (7005) is opened; the check valve A(7001) is opened, the high-pressure gas in the gas storage tank (2) flows through the connecting post (5) and the relief valve (7) to the connecting tube (6).

7. The integrated alcoholic beverage fresh-keeping barrel system as claimed in claim 6, wherein the check valve core A(7063) includes a sealing gasket (7065), a top rod (7066), and a check valve shutter body (7067); the check valve shutter body (7067) is in the form of a stepped cylindrical structure and is provided with a small-diameter trough (7068) and a large-diameter annular trough (7069); the top rod (7066) is inserted into the small-diameter trough (7068) after passing through a central hole of the sealing gasket (7065); one end face of the sealing gasket (7065) is fixed in the large-diameter annular trough (7069), another end face of the sealing gasket (7065) is in contact with the relief valve outlet hole (7005);

the check valve return spring A(7064) is sleeved on an outer periphery of the check valve core A(7063); one end of the check valve return spring A(7064) abuts against an inner bottom surface of the check valve body A(7061), another end of the check valve return spring A(7064) abuts against a stepped outer periphery of the check valve shutter body (7067);

the top rod (7066) of the check valve core A includes a head portion and a rod portion, the head portion of the top rod is raised to form the force action portion A(7062), the head portion of the top rod passes through the relief valve outlet hole (7005) of the relief valve bonnet (7004), the force action portion A(7062) extends out of an outer side of the relief valve bonnet (7004).

8. The integrated alcoholic beverage fresh-keeping barrel system as claimed in claim 7, wherein the end of the connecting tube (6), connected with the dispenser, is provided with a connecting tube outlet hole (6005), the check valve body B(6002) is provided with a check valve core B(6007) therein for closing or opening the connecting tube outlet hole and a check valve return spring B(6008) for returning the check valve core B(6007);

the check valve core B(6007) is to contact and seal against the connecting tube outlet hole (6005) and has a force action portion B(6009); when a force is applied to the force action portion B(6009) of the check valve core B(6007), the check valve return spring B(6008) is compressed, the check valve core B(6007) is disengaged from the connecting tube outlet hole (6005) to open the connecting tube outlet hole (6005).

9. The integrated alcoholic beverage fresh-keeping barrel system as claimed in claim 7, further comprising a first clamping hoop (6017) for fixing the connecting tube (6) and the relief valve (7) together and a second clamping hoop (6021) for fixing the connecting tube (6) and the dispenser (8) together.

10. The integrated alcoholic beverage fresh-keeping barrel system as claimed in claim 7, wherein the structure of the check valve core A is the same as that of the check valve core B.

11. The integrated alcoholic beverage fresh-keeping barrel system as claimed in claim 8, wherein the dispenser (8) includes an operating device (8016), a wine tube connecting seat (8014) and a dispenser shaft (8015) which are sequentially arranged from top to bottom, and the dispenser further includes a dispenser seat (8005) surrounding the dispenser shaft (8015).

12. The integrated alcoholic beverage fresh-keeping barrel system as claimed in claim 11, wherein the dispenser seat (8005) is provided with an intake end (8006); the check valve B(6002) of the connecting tube (6) is inserted into the intake end (8006); the dispenser shaft (8015) is axially movably disposed along the dispenser seat (8005); the wine tube connecting seat (8014) includes a horizontal portion and a longitudinal portion, the longitudinal portion of the wine tube connecting seat (8014) is connected to an upper end of the dispenser shaft (8015), and the horizontal portion is formed with the liquid outlet end (8007) for mounting the wine tube (10);

the dispenser shaft (8015) includes a dispenser shaft annular groove (8012) disposed along an axial surface thereof and a dispenser shaft longitudinal hole (8013) penetrating the dispenser shaft (8015), the dispenser shaft annular groove (8012) has a bevel end face;

a bottom of the dispenser seat (8005) is provided with a dispenser seat sealing gasket (8027); a lower end of the dispenser shaft (8015) is provided with a dispenser shaft sealing gasket (8028) which is synchronously moved along with the dispenser shaft;

the wine tube connecting seat (8014) is provided with a flow passage communicated with the dispenser shaft longitudinal hole (8013) and the liquid outlet end (8007).

13. The integrated alcoholic beverage fresh-keeping barrel system as claimed in claim 12, wherein the operating device (8016) includes a press rod (8017) and a handle (8018); the dispenser seat (8005) extends upward to form a bracket; a head end of the press rod (8017) is disposed on a top of the wine tube connecting seat (8014) and is hinged to the bracket of the dispenser seat (8005), the head end of the press rod (8017) is provided with a cam (8019) which is mated with and in contact with the top of the wine tube connecting seat (8014); when the cam (8019) is rotated, the cam (8019) presses the wine tube connecting seat (8014) down.

14. The integrated alcoholic beverage fresh-keeping barrel system as claimed in claim 13, wherein a rear end of the press rod (8017) is rotatably connected to the handle (8018); the handle (8018) has a self-locking structure; when the handle (8018) is in a self-locking state, the handle and the press rod are in a firm right angle state, and the force exerted by the cam on the wine tube connecting seat (8014) is zero; when the handle (8018) is rotated for the handle (8018) and the press rod (8017) to be rigidly and linearly connected, the handle (8018) is pulled to drive the cam (8019) of the press rod to rotate.

15. The integrated alcoholic beverage fresh-keeping barrel system as claimed in claim 14, wherein the rear end of the press rod (8017) is formed with a notch (8020) and a counterbore step (8021), the operating device (8016) further includes a rotating pin (8022) and a spring (8023); the handle (8018) includes a handle hole (8024) provided with the spring (8023); one end of the rotating pin (8022) is hinged to the notch (8020), another end of the rotating pin (8022) is inserted into the spring (8023) and the handle hole (8024), two ends of the spring (8023) abut against the handle hole (8024) and the rotating pin (8022) respectively; one end of the handle (8018), located in the notch (8020), is provided with a handle boss (8025) engaged with the counterbore step (8021).

16. The integrated alcoholic beverage fresh-keeping barrel system as claimed in claim 15, wherein the wine tube comprises an inner tube (1045) and an outer tube (1046) which are connected end to end, one end of the inner tube is connected to the liquid outlet end (8007) of the wine tube connecting seat (8014), the end of the inner tube, connected to the wine tube connecting seat (8014), is placed horizontally; the end of the inner tube, close to the wine tube connecting seat (8014), is provided with an expanding step (1047) and an O-shaped ring (1048), the inner tube (1045) and the wine tube connecting seat (8014) are rotatably connected through a nut (1049); another end of the inner tube (1045) has an inner tube bending end bent by 90 degrees; another end of the outer tube has an outer tube bending end bent by 90 degrees; the outer tube bending end is inserted into the inner tube bending end and rotatably connected through a nut (1050); a portion of the outer tube, inserted into the inner tube, is provided with the expanding step (1047) and the O-shaped ring (1048); another end of the outer tube (1046) is a wine outlet (1051).

* * * * *